US010295298B2

(12) United States Patent
Shaffer et al.

(10) Patent No.: US 10,295,298 B2
(45) Date of Patent: May 21, 2019

(54) CROSSBOW COCKING SYSTEM

(71) Applicant: Hunter's Manufacturing Company, Inc., Suffield, OH (US)

(72) Inventors: Michael Shaffer, Mogadore, OH (US); Gary Smith, East Canton, OH (US)

(73) Assignee: Hunter's Maufacturing Company, Inc., Suffield, OH (US)

( * ) Notice: Subject to any disclaimer, the term of this patent is extended or adjusted under 35 U.S.C. 154(b) by 0 days.

(21) Appl. No.: 15/910,416

(22) Filed: Mar. 2, 2018

(65) Prior Publication Data

US 2019/0011215 A1 Jan. 10, 2019

Related U.S. Application Data

(60) Provisional application No. 62/529,022, filed on Jul. 6, 2017.

(51) Int. Cl.

| | |
|---|---|
| ***F41B 5/18*** | (2006.01) |
| ***F41B 5/14*** | (2006.01) |
| ***F41B 5/12*** | (2006.01) |

(52) U.S. Cl.

CPC ..... *F41B 5/1469* (2013.01); *F41B 5/12* (2013.01); *F41B 5/148* (2013.01); *F41B 5/123* (2013.01)

(58) Field of Classification Search

CPC ..... F41B 5/1469
USPC ..... 124/25, 86
See application file for complete search history.

(56) References Cited

U.S. PATENT DOCUMENTS

| | | | |
|---|---|---|---|
| 2,092,361 | A | 9/1937 | Shim |
| 3,043,287 | A | 7/1962 | Nelson |
| 3,561,419 | A | 2/1971 | Cucuzza, Sr. |
| 3,670,711 | A | 6/1972 | Firestone |
| 3,739,765 | A | 6/1973 | Moore |
| 4,192,281 | A | 3/1980 | King |
| 4,246,883 | A | 1/1981 | Ash |
| 4,593,675 | A | 6/1986 | Waiser |
| 4,603,676 | A | 8/1986 | Luoma |
| 4,649,892 | A | 3/1987 | Bozek |
| 4,662,345 | A | 5/1987 | Stephens |
| 4,665,885 | A | 5/1987 | Glomski et al. |

(Continued)

OTHER PUBLICATIONS

A Guide to the Crossbow, by W.F. Paterson, published by the Society of Archer-Antiquaries, 1990.

(Continued)

*Primary Examiner* — Alexander R Niconovich
(74) *Attorney, Agent, or Firm* — Emerson Thomson Bennett, LLC

(57) ABSTRACT

Provided is a crossbow cocking system comprising a sled, an elongated cocking cable, a first handle, and a second handle. The sled may have a first side having a first bowstring retainer, a first arm having a first set of handle engagement features adapted for engagement with a first handle, and a first pulley rotatably engaged with the first arm; and a second side having a second bowstring retainer, and a second arm having a second set of handle engagement features adapted for engagement with a second handle, a second pulley rotatably engaged with the second arm. The first and the second handle may each be engaged to the elongated cocking cable, and be ergonomically adapted to permit an associated user to operate the each handle during a cocking operation with a hand in a vertical hand position.

3 Claims, 32 Drawing Sheets

(56) References Cited

U.S. PATENT DOCUMENTS 4,719,897 A 1/1988 Gaudreau
4,721,092 A 1/1988 Waiser
4,942,861 A 7/1990 Bozek
5,115,795 A 5/1992 Farris
5,205,267 A 4/1993 Burdick
5,215,069 A 6/1993 Liu
5,220,906 A 6/1993 Choma
5,243,956 A * 9/1993 Luehring ..... F41B 5/12 124/25
5,433,186 A 7/1995 Corwin
5,437,260 A 8/1995 King
5,445,139 A 8/1995 Bybee
5,553,596 A 9/1996 Bednar
5,598,829 A 2/1997 Bednar
5,649,520 A 7/1997 Bednar
5,678,528 A 10/1997 Hadley
5,987,724 A 11/1999 Kleman
6,095,128 A 8/2000 Bednar
6,286,496 B1 9/2001 Bednar
6,874,491 B2 4/2005 Bednar
6,913,007 B2 * 7/2005 Bednar ..... F41B 5/123 124/25
7,100,590 B2 * 9/2006 Chang ..... F41B 5/123 124/25
7,624,725 B1 * 12/2009 Choma ..... F41B 5/1469 124/25
7,784,453 B1 8/2010 Yehle
8,443,790 B2 * 5/2013 Pestrue ..... F41B 5/1469 124/25
8,499,753 B2 * 8/2013 Bednar ..... F41B 5/123 124/25
9,285,182 B2 * 3/2016 Bednar ..... F41B 5/1469
9,618,295 B1 * 4/2017 Rentz ..... F41B 5/1469
2006/0086346 A1 * 4/2006 Middleton ..... F41B 5/12 124/25
2008/0149084 A1 * 6/2008 Whalen ..... F41B 5/1469 124/35.2
2010/0170488 A1 1/2010 Rasor et al.
2011/0232619 A1 * 9/2011 Bednar ..... F41B 5/12 124/86
2012/0037139 A1 * 2/2012 Barnett ..... F41B 5/1469 124/86
2014/0069403 A1 * 3/2014 Simonds ..... F41B 5/123 124/25
2015/0000646 A1 * 1/2015 Schley ..... F41B 5/1469 124/86
2017/0003098 A1 * 1/2017 Houle ..... F41B 5/12
2017/0343313 A1 * 11/2017 Ozanne ..... F41B 5/1469

OTHER PUBLICATIONS

European Crossbows, A Survey by Josef Alm, copyrighted by the Trustees of the Royal Armouries and the Arms and Armour Society, 1994.

The Book of the Crossbow, by Ralph Payne-Gallwey, published by Dover Publications, Inc. of New York, 1995.

* cited by examiner

CROSSBOW COCKING SYSTEM

CROSS-REFERENCE TO RELATED APPLICATIONS

This application claims the benefit of U.S. Provisional Application No. 62/529,022, filed Jul. 6, 2017, the entirety of which is fully incorporated by reference herein.

BACKGROUND

The present subject matter is directed to apparatuses and methods regarding crossbows. More specifically the present subject matter is directed to apparatuses and methods for cocking a crossbow.

Crossbows have been used for many years as a weapon for hunting and fishing, and for target shooting. Crossbows typically comprise a bowstring movable between a cocked and uncocked position. The operation of moving the bowstring to the cocked position is a cocking operation.

Cocking operations are sometime assisted using a cocking device. Cocking devices may comprise simple pulley systems operated by pulling one or more handles by hand by an associated user. The design of the one of more handles can influence user comfort or ergonomics or both during a cocking operation. It remains desirable to produce a cocking device with handles that improve user comfort or ergonomics during a cocking operation.

SUMMARY

Provided is a crossbow cocking system comprising a sled, an elongated cocking cable, a first handle, and a second handle. The sled may have a first side having a first bowstring retainer, a first arm having a first set of handle engagement features adapted for engagement with a first handle, and a first pulley rotatably engaged with the first arm; and a second side having a second bowstring retainer, and a second arm having a second set of handle engagement features adapted for engagement with a second handle, a second pulley rotatably engaged with the second arm. The first and the second handle may each be engaged to the elongated cocking cable, and be ergonomically adapted to permit an associated user to operate the each handle during a cocking operation with a hand in a vertical hand position.

BRIEF DESCRIPTION OF THE DRAWINGS

The present subject matter may take physical form in certain parts and arrangement of parts, embodiments of which will be described in detail in this specification and illustrated in the accompanying drawings which form a part hereof and wherein.

DETAILED DESCRIPTION

Figure 1:
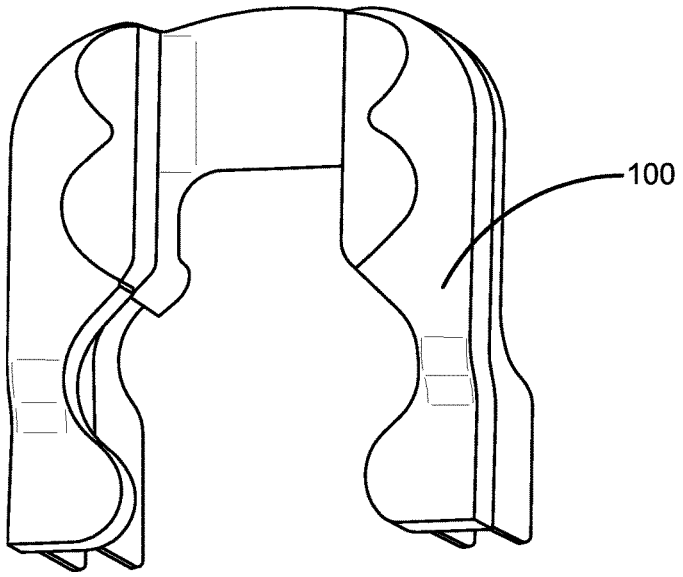
FIG. 1 is a perspective view of one embodiment of a crossbow cocking sled.
Figure 2:
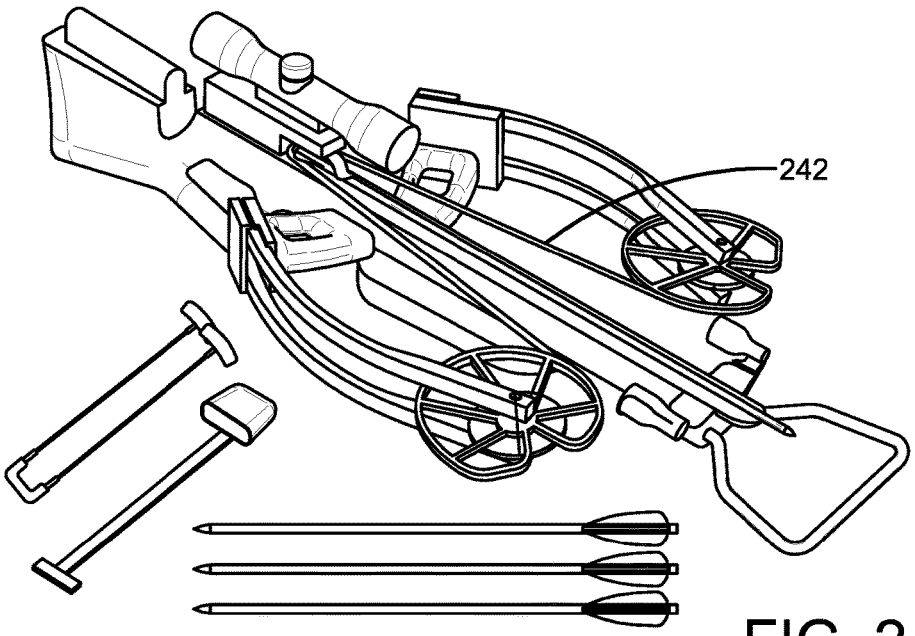
FIG. 2 is a perspective view of one embodiment of a crossbow and associated components.
Figure 3:
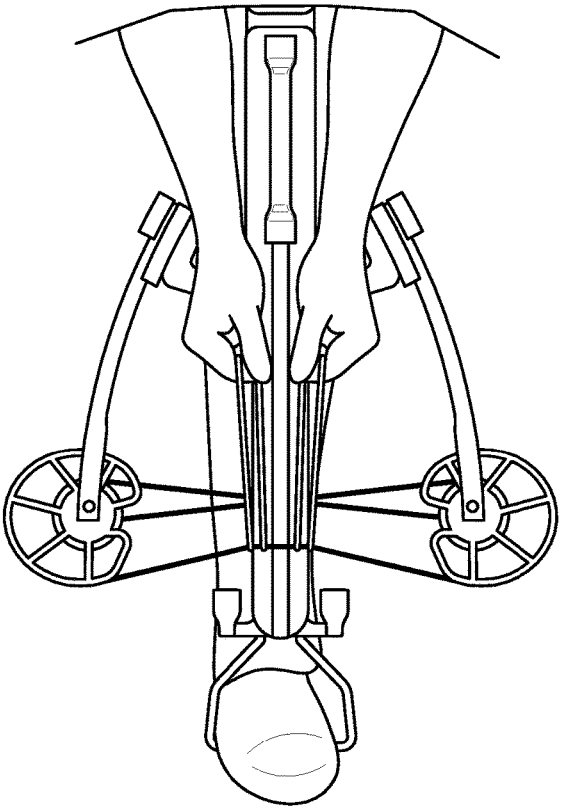
FIG. 3 is a picture of a crossbow being cocked by a user.
Figure 4:
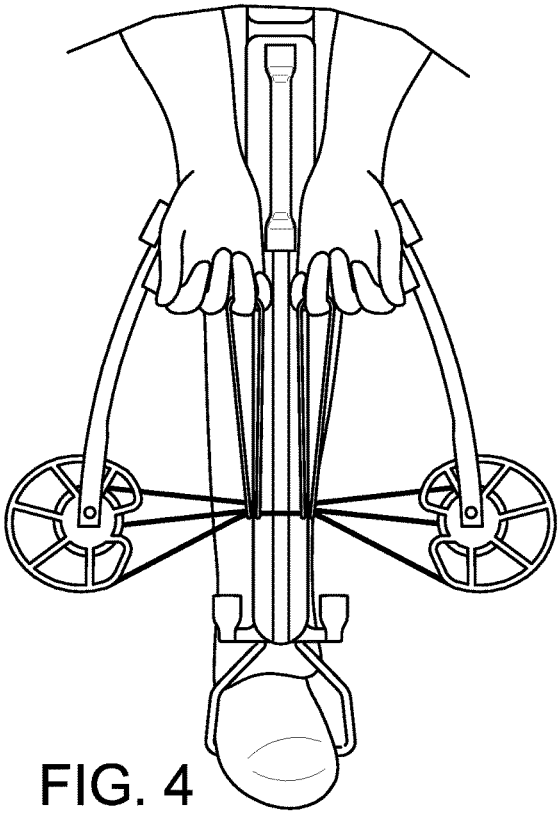
FIG. 4 is a picture of a crossbow being cocked by a user.
Figure 5:
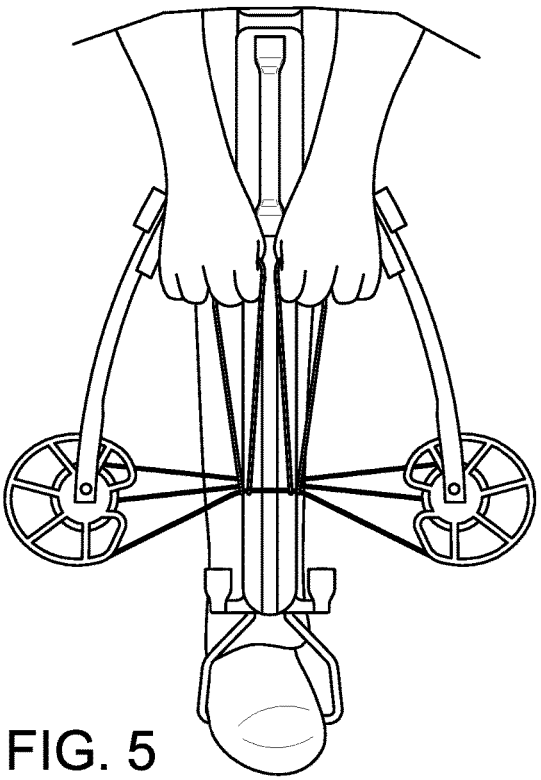
FIG. 5 is a picture of a crossbow being cocked by a user.
Figure 6:
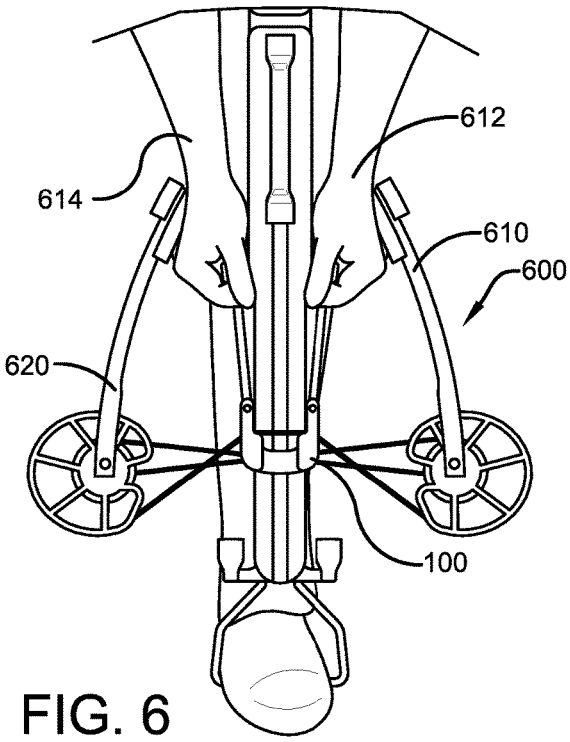
FIG. 6 is a picture of a crossbow being cocked by a user.
Figure 7:
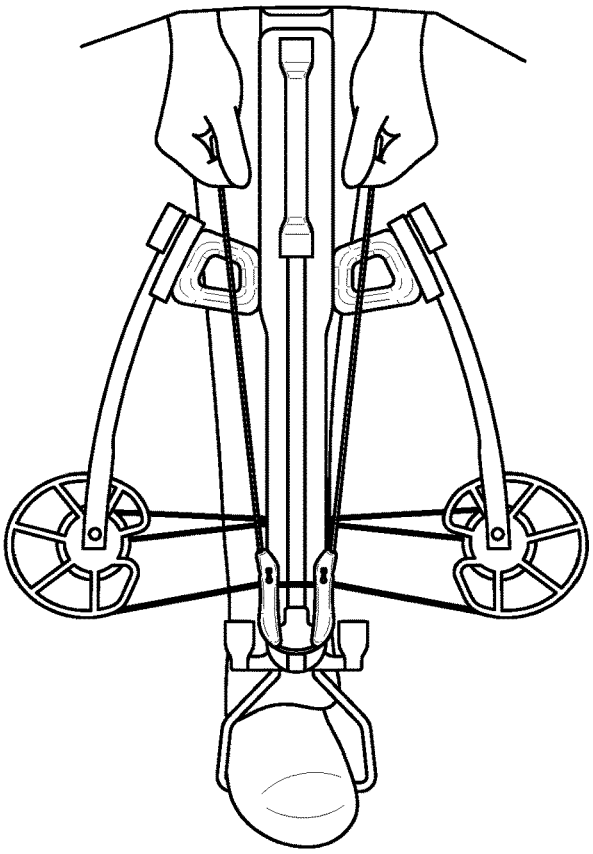
FIG. 7 is a picture of a crossbow being cocked by a user.
Figure 8:
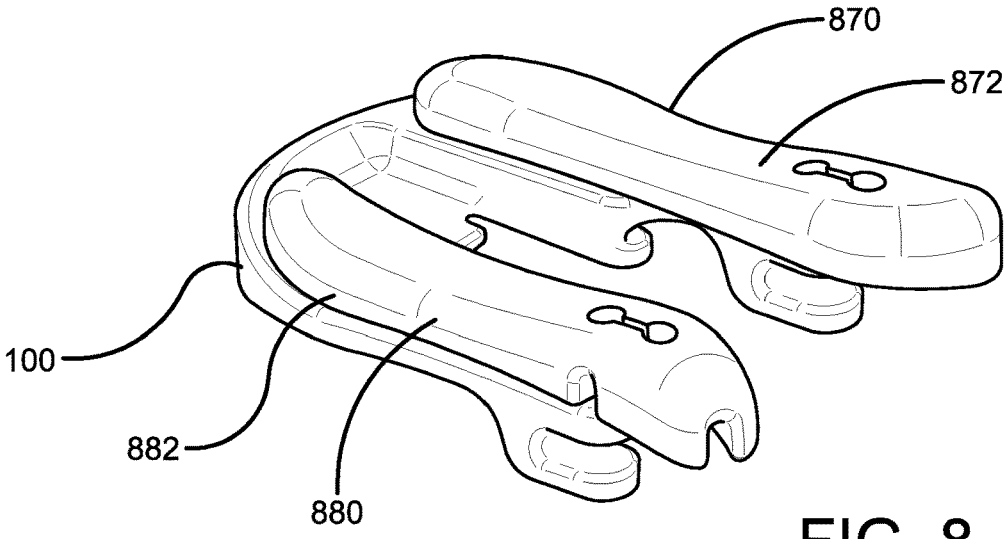
FIG. 8 is a perspective view of one embodiment of a crossbow cocking system.
Figure 9:
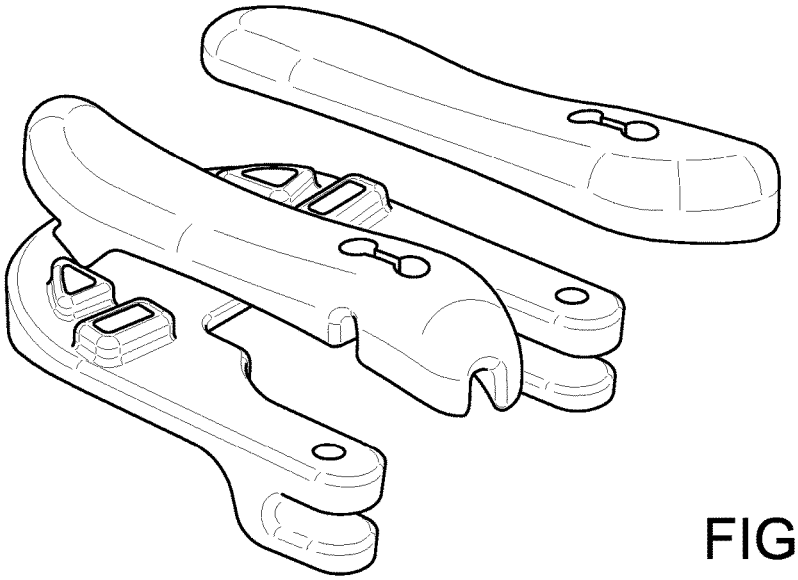
FIG. 9 is a perspective exploded view of one embodiment of a crossbow cocking system.
Figure 10:
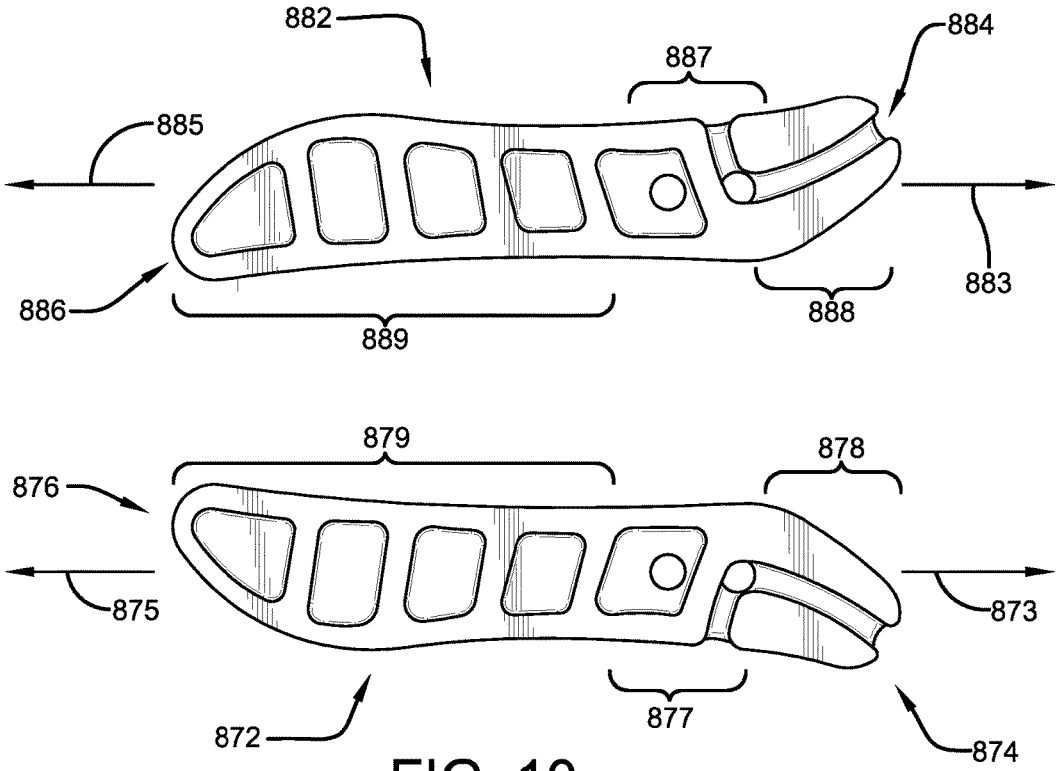
FIG. 10 is a view of one embodiment of the underside of the handles of a crossbow cocking system.
Figure 11:
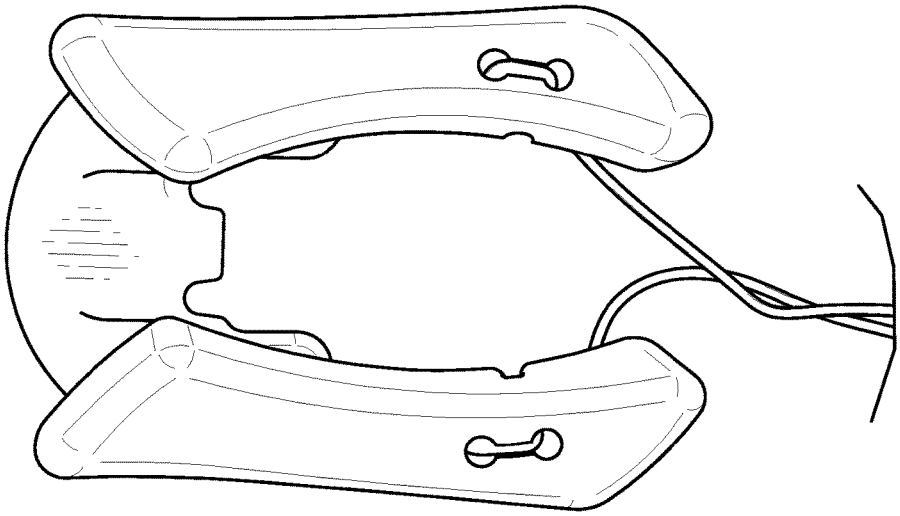
FIG. 11 is a view of one embodiment of a crossbow cocking system.
Figure 12:
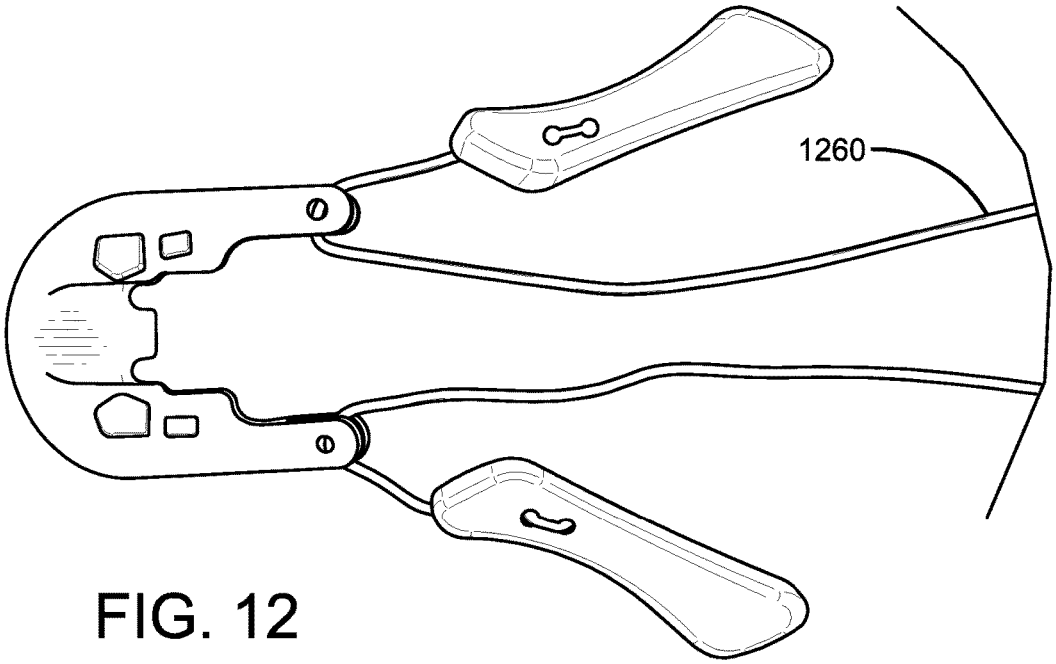
FIG. 12 is a view of one embodiment of a crossbow cocking system.
Figure 13:
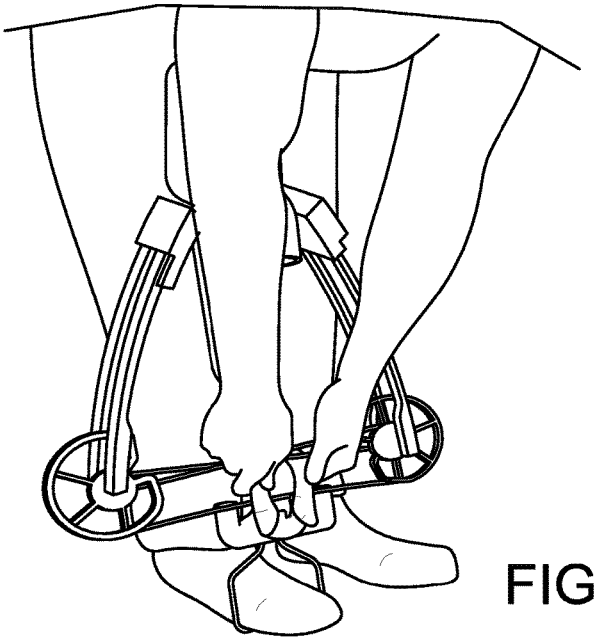
FIG. 13 is a picture of a crossbow being cocked by a user.
Figure 14:
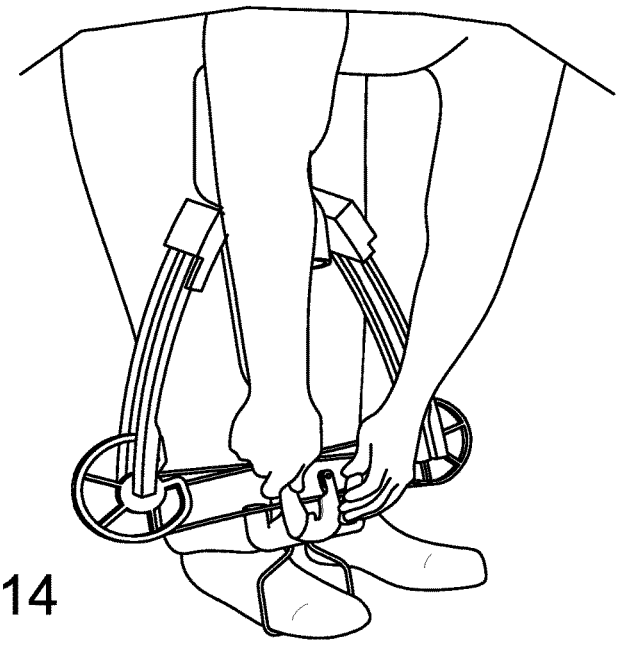
FIG. 14 is a picture of a crossbow being cocked by a user.
Figure 15:
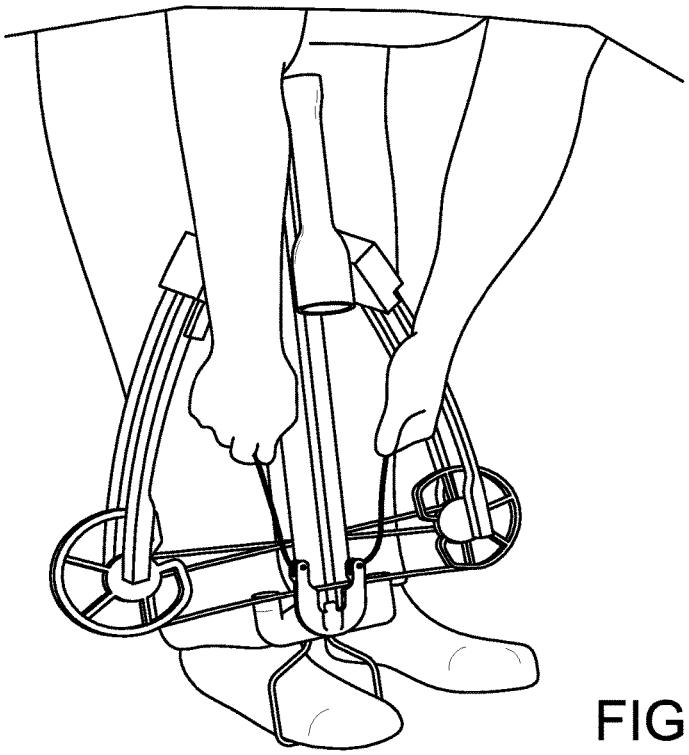
FIG. 15 is a picture of a crossbow being cocked by a user.
Figure 16:
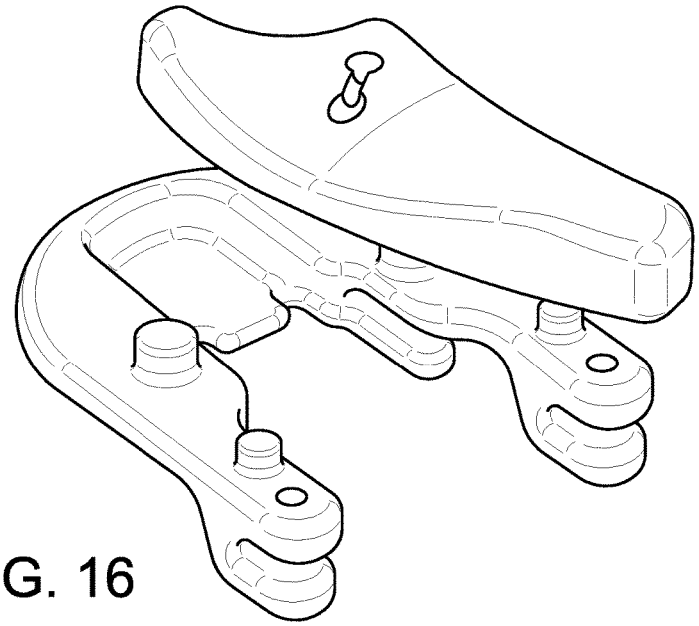
FIG. 16 is a perspective view of one embodiment of a crossbow cocking system.
Figure 17:
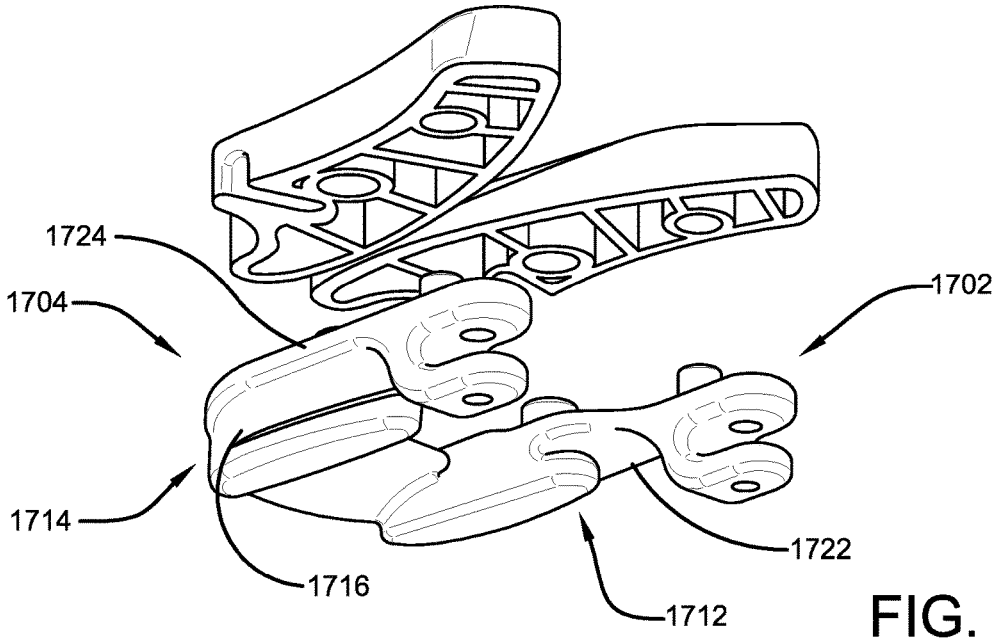
FIG. 17 is a perspective exploded view of one embodiment of a crossbow cocking system.
Figure 18:
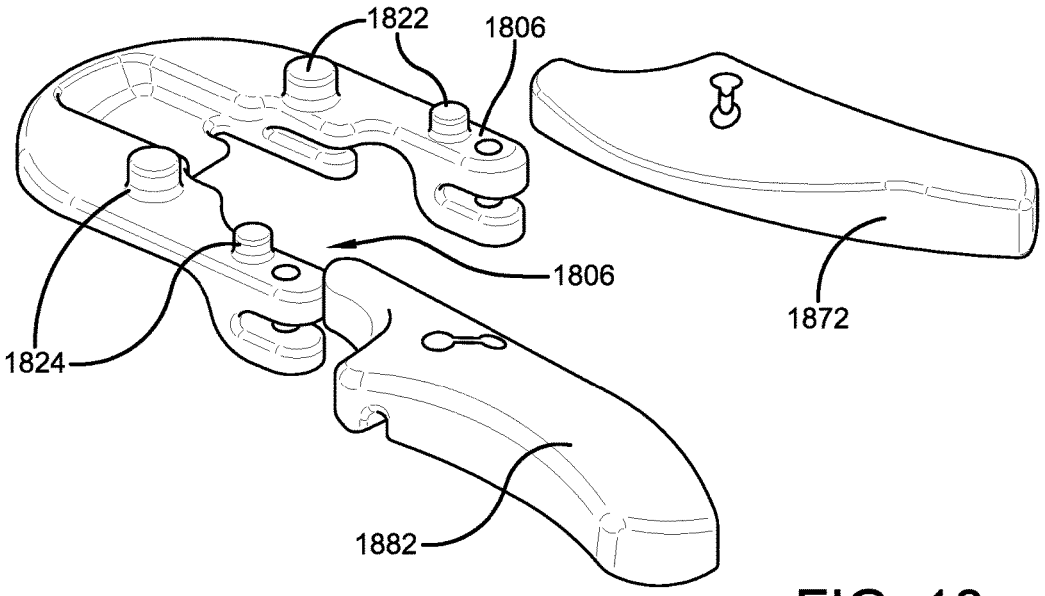
FIG. 18 is a perspective exploded view of one embodiment of a crossbow cocking system.
Figure 19:
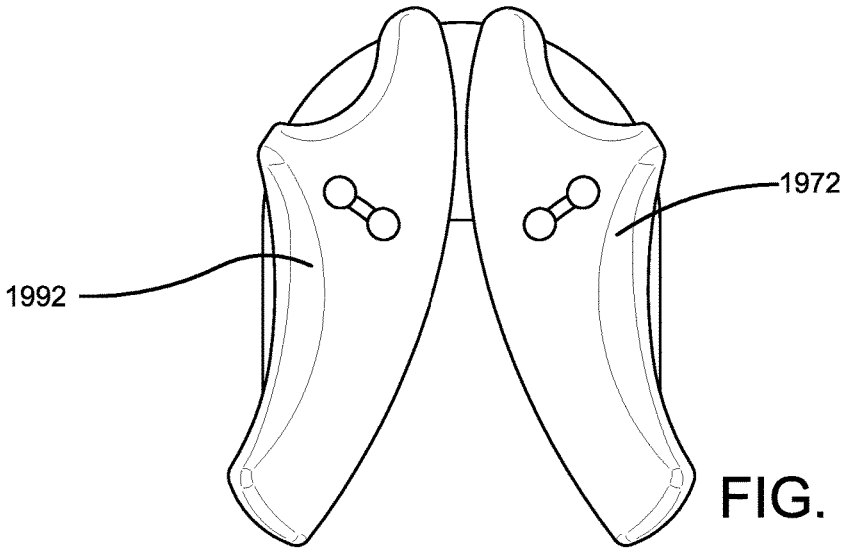
FIG. 19 is a perspective view of one embodiment of a crossbow cocking system.
Figure 20:
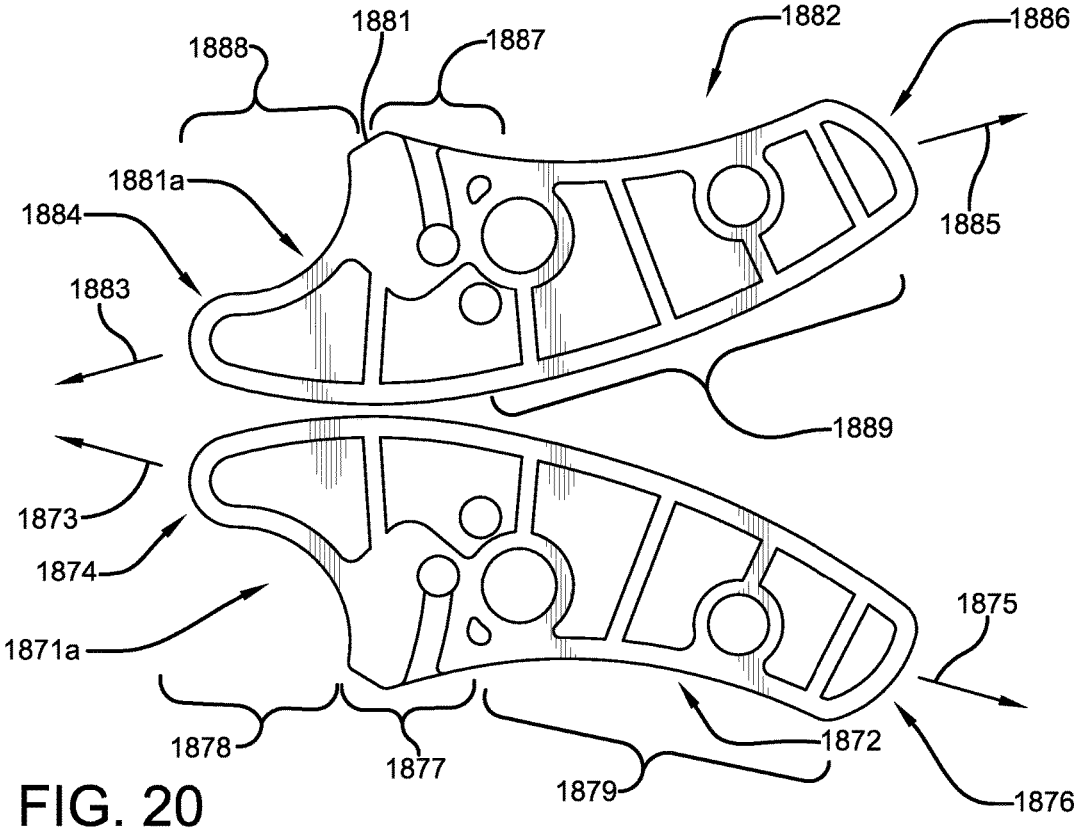
FIG. 20 is a view of one embodiment of the underside of the handles of a crossbow cocking system.
Figure 21:
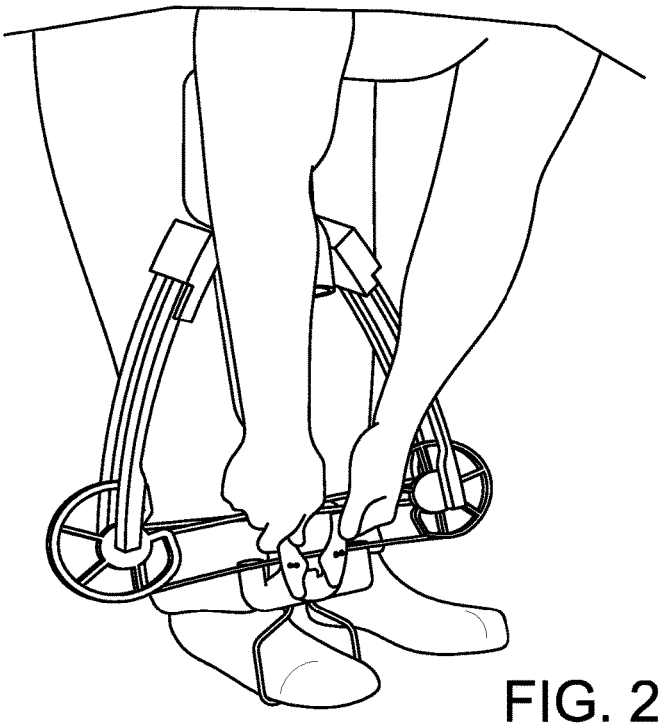
FIG. 21 is a picture of a crossbow being cocked by a user.
Figure 22:
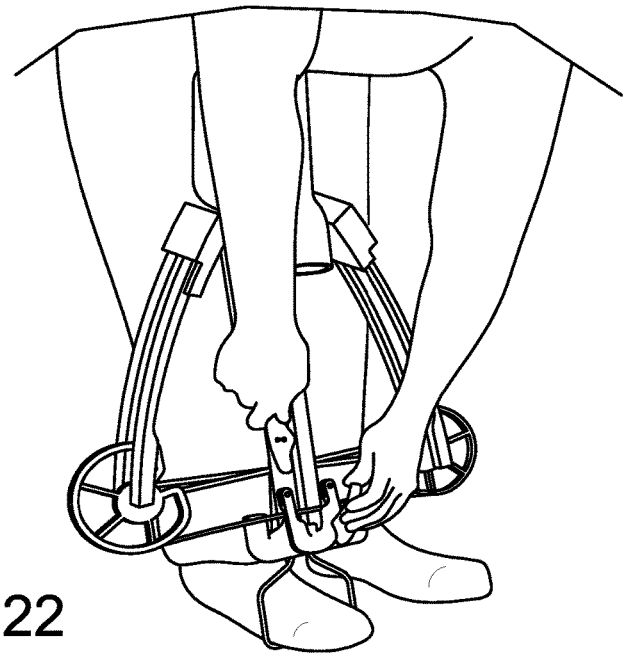
FIG. 22 is a picture of a crossbow being cocked by a user.
Figure 23:
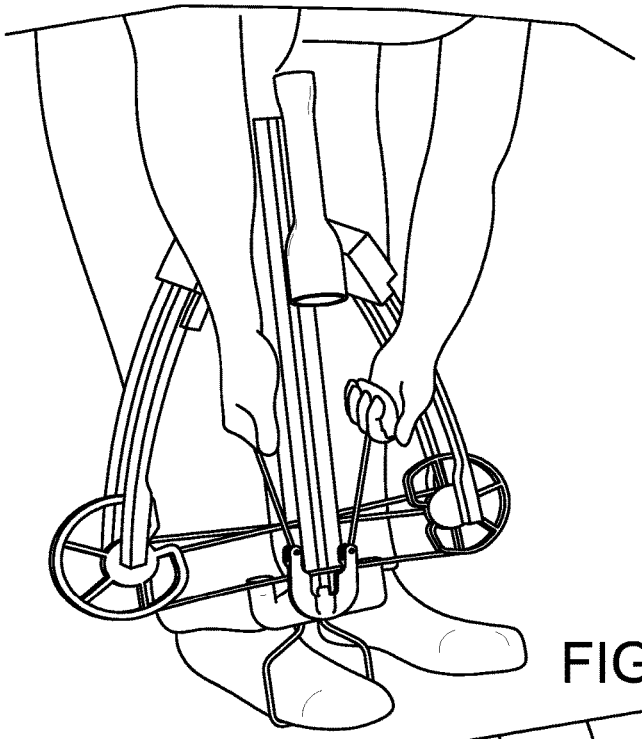
FIG. 23 is a picture of a crossbow being cocked by a user.
Figure 24:
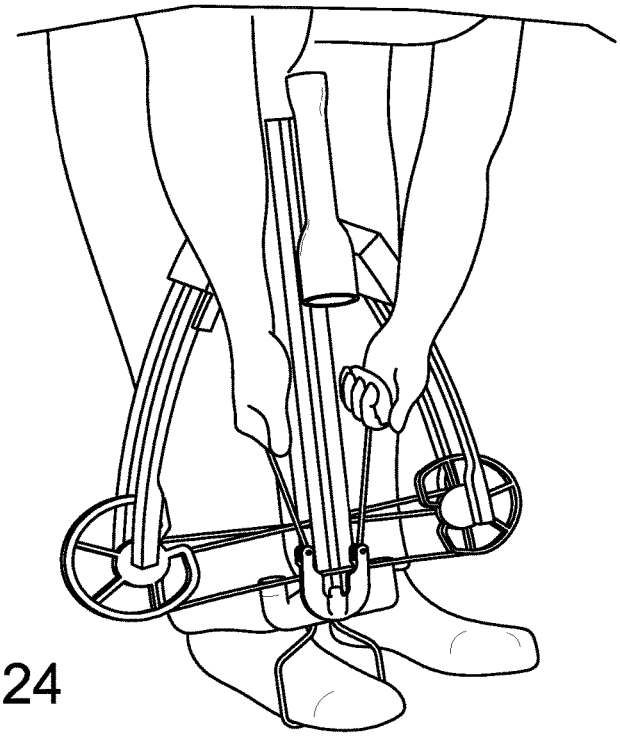
FIG. 24 is a picture of a crossbow being cocked by a user.
Figure 25:
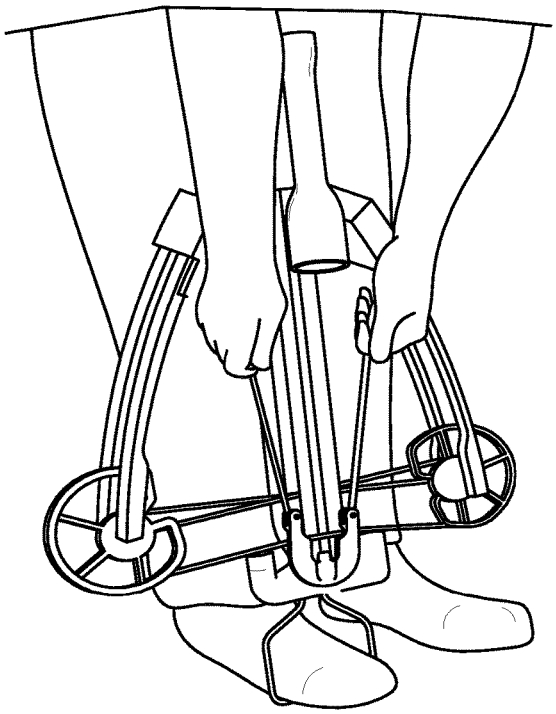
FIG. 25 is a picture of a crossbow being cocked by a user.
Figure 26:
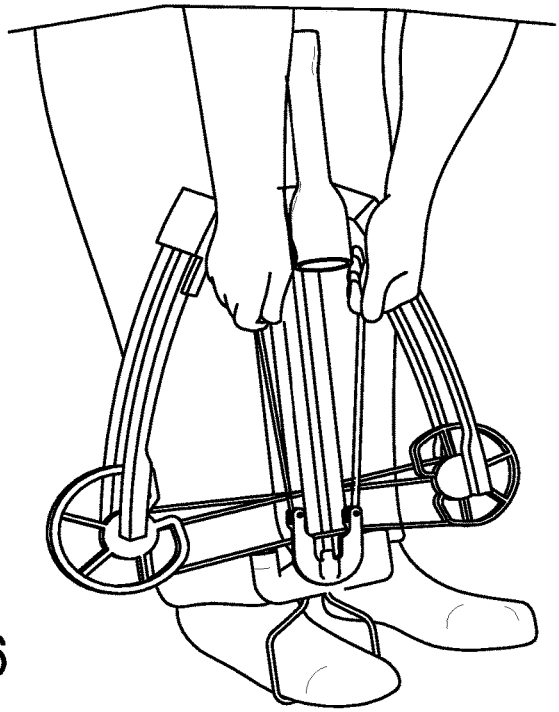
FIG. 26 is a picture of a crossbow being cocked by a user.
Figure 27:
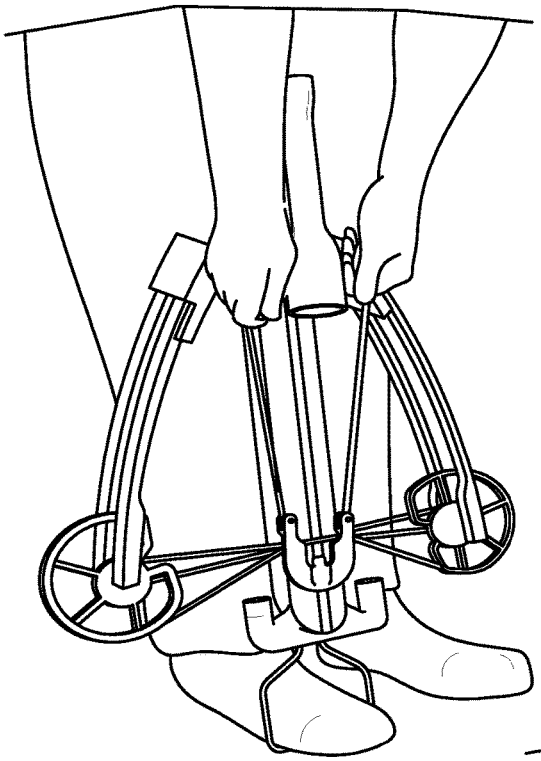
FIG. 27 is a picture of a crossbow being cocked by a user.
Figure 28:
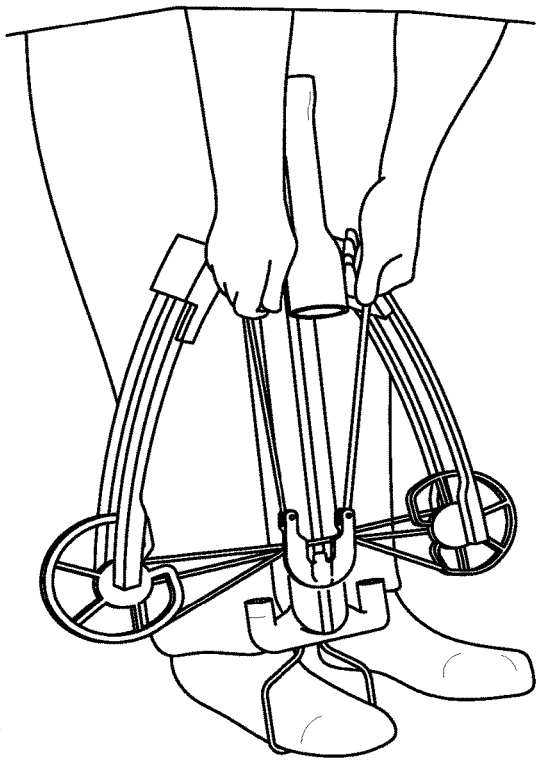
FIG. 28 is a picture of a crossbow being cocked by a user.
Figure 29:
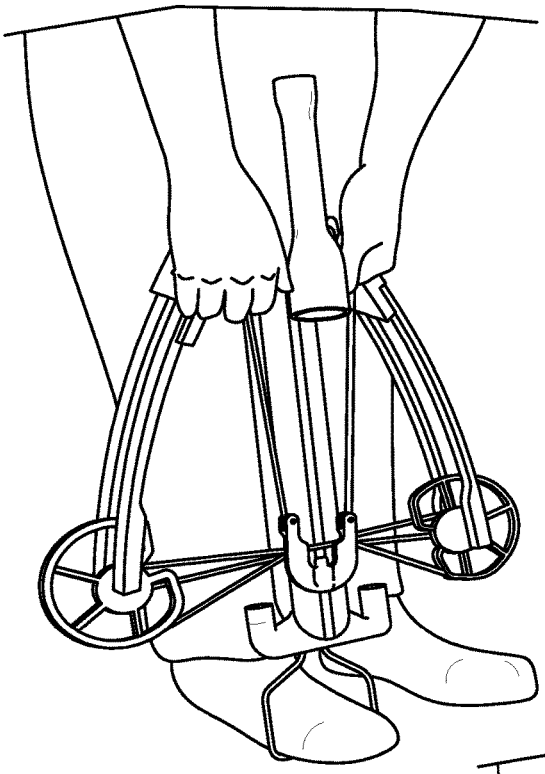
FIG. 29 is a picture of a crossbow being cocked by a user.
Figure 30:
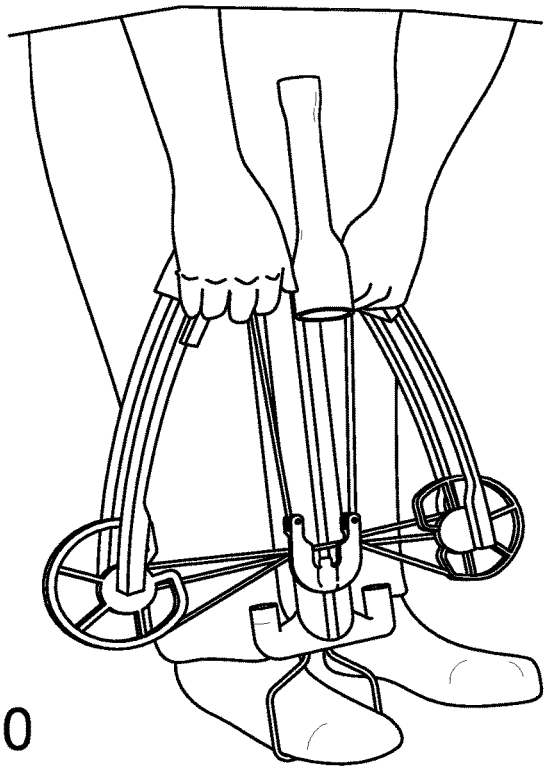
FIG. 30 is a picture of a crossbow being cocked by a user.
Figure 31:
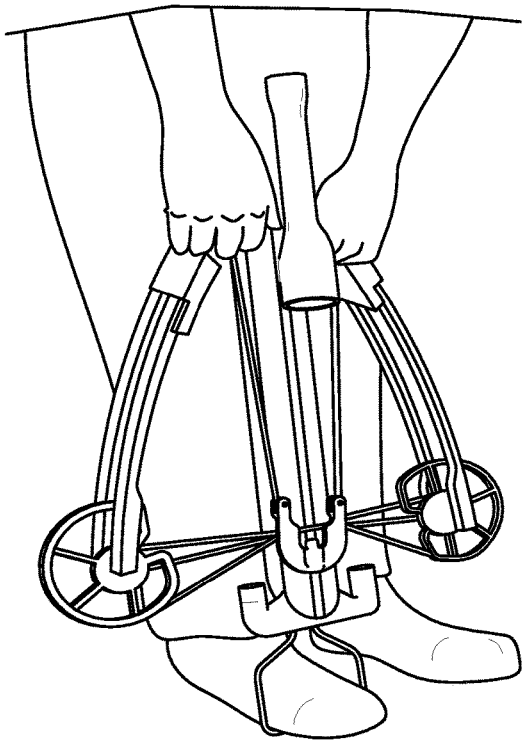
FIG. 31 is a picture of a crossbow being cocked by a user.
Figure 32:
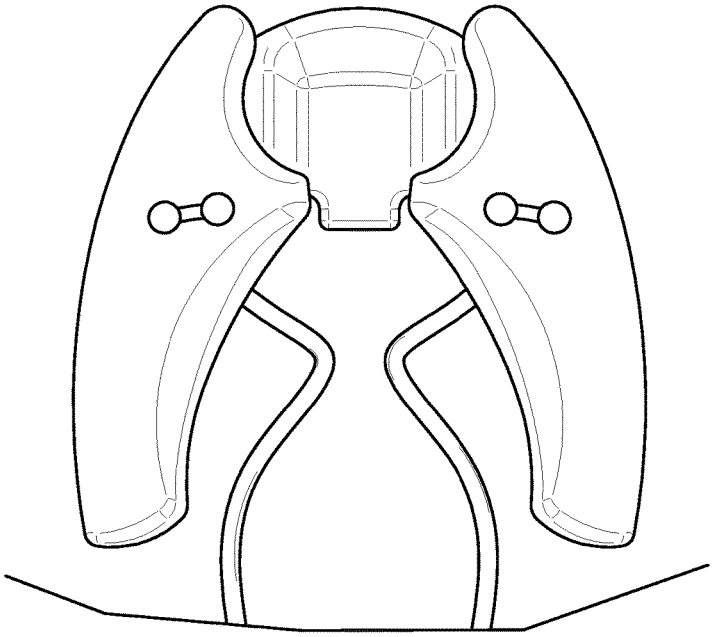
FIG. 32 is a perspective view of one embodiment of a crossbow cocking system.
Figure 33:
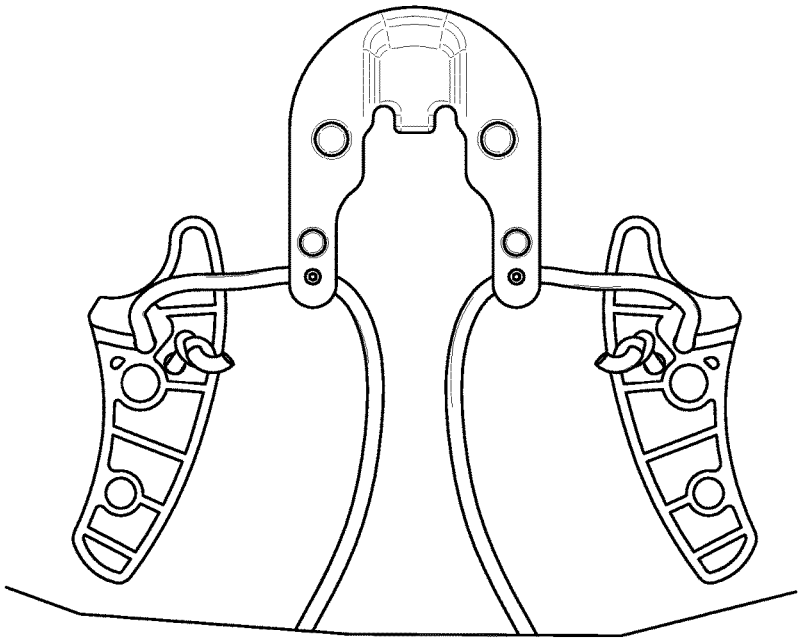
FIG. 33 is a perspective exploded view of one embodiment of a crossbow cocking system.

Referring now to the drawings wherein the showings are for purposes of illustrating embodiments of the present subject matter only and not for purposes of limiting the same, and wherein like reference numerals are understood to refer to like components, provided is a crossbow cocking system 600 and a method for using same. A crossbow cocking system 600 is device adapted to be used by an associated user 610 on an associated crossbow 620 to cock the associated crossbow 620 using one or more hands 612, 614 of the associated user 610.

In some non-limiting embodiment, a crossbow cocking system 600 may comprise a sled 100, an elongated cocking cable 1260, a first handle 870, and a second handle 880. It is contemplated that the first handle may take a variety of forms. First handle 870 is just one acceptable non-limiting form and other acceptable non-limiting forms are described below. It is contemplated that the second handle may take a variety of forms. Second handle 880 is just one acceptable non-limiting form and other acceptable non-limiting forms are described below.

A sled 100 may have a first side 1702, and a second side 1704 opposite the first side 1702 and offset from the first side 1702 by a sled gap 1806. The first side 1702 may have a first bowstring retainer 1712, and a first arm 1722 having a first set of handle engagement features 1822 adapted for engagement with a first handle 870. The first bowstring retainer 1712 may have or define a groove or other similar feature adapted to retain an associated bowstring 242 of an associated crossbow 620 during a cocking operation. The first side 1702 may have a first pulley 3728 rotatably engaged with the first arm 1722. The second side 1704 may have a second bowstring retainer 1714, and a second arm 1724 having a second set of handle engagement features 1824 adapted for engagement with a second handle 880. The second bowstring retainer 1714 may have or define a groove 1716 or other similar feature adapted to retain an associated bowstring 242 of an associated crossbow 620 during a cocking operation. It should be noted that, in some embodiments, the groove 1716 on the second bowstring retainer 1714 may be substantially symmetric across the sled gap 1806 with the groove on the first bowstring retainer 1712. The second side 1704 may have a second pulley 3729 rotatably engaged with the second arm 1724. In some embodiments, the first arm 1722 and the second arm may be substantially linear components parallel to one another, but this is not limiting: it is within the scope of the present subject matter for the sides 1702, 1704 to be angled with respect to one another, or to be curved members where the curvature is described by a planar curve or a three dimensional curve. It should be understood that the handle engagement features 1822, 1824 may be studs adapted to engage counterpart components in the handles by friction forces, they may also comprise magnets adapted to engage ferrous or magnetic counterpart components in the handles by magnetic forces, or a ball and detent set, or otherwise as chosen with good engineering judgment.

The sled gap 1806 may be of sufficient width to accommodate fitting around an associated trigger assembly of an associated crossbow. This accommodation to fit around an associated trigger assembly, may permit the an associated bowstring to be cocked by the sled 100 to some distance in the associated trigger assembly without interfering with or hitting the associated trigger assembly during a cocking operation.

The elongated cocking cable 1260 may have a first end 1262, and a second end 1264 opposite the first end 1262. The elongated cocking cable may comprise a rope, cord, cable, or other elongated flexible component chosen with good engineering judgment. Without limitation, the elongated cocking cable may comprise linen, cotton, coir, jute, straw, sisal, polypropylene, nylon, polyester, polyethylene, aramid, acrylic, or some combination thereof. The elongated cocking cable 1260 is engaged at the first end 1262 to a first handle 870, at the second end 1264 to a second handle 880, and extends through the sled 100.

The first handle 870 may be operationally engaged to the elongated cocking cable 1260 at the first end 1262. The first handle is ergonomically adapted to permit an associated user to operate the first handle during a cocking operation with a first hand in a vertical hand position. Acceptable non-limiting forms for the first handle 870 include first compact handle 872, first transition handle 1872, a first T-handle 3572, and a first loop handle 4472.

A first compact handle 872 may be elongated to define a first forward direction 873 toward a first handle front 874, and may be elongated to define a first rearward direction 875 toward a first handle back 876 opposite the first handle front 874. A first compact handle 872 may have a first cable engagement region 877 biased toward the first handle front 874 to define a first forward handle region 878 between the first handle front 874 and the first cable engagement region 877 and a first rearward handle region 879 between the first handle back 876 and the first cable engagement region 877. The first forward handle region 878 may increase in cross-sectional area in the first forward direction 873 over at least a portion thereof. The first rearward handle region 879 may increase in cross-sectional area in the first rearward direction 875 over at least a portion thereof.

A first transition handle 1872 may be elongated to define a first forward direction 1873 toward a first handle front 1874 and a first rearward direction 1875 toward a first handle back 1876 opposite the first handle front 1874. A first transition handle 1872 may have a cable engagement region 1877 biased toward the first handle front 1874 to define a first forward handle region 1878 between the first handle front 1874 and the cable engagement region 1877, a first rearward handle region 1879 between the first handle back 1876 and the cable engagement region 1877, and a spur 1871 or projection extending from the handle 1872 between the first forward handle region 1878 and the first rearward handle region 1879. In some non-limiting embodiments, the first forward handle region 1878 may have a convex finger receptacle 1871*a* adjacent to and partially defined by the spur 1871.

Figure 34:
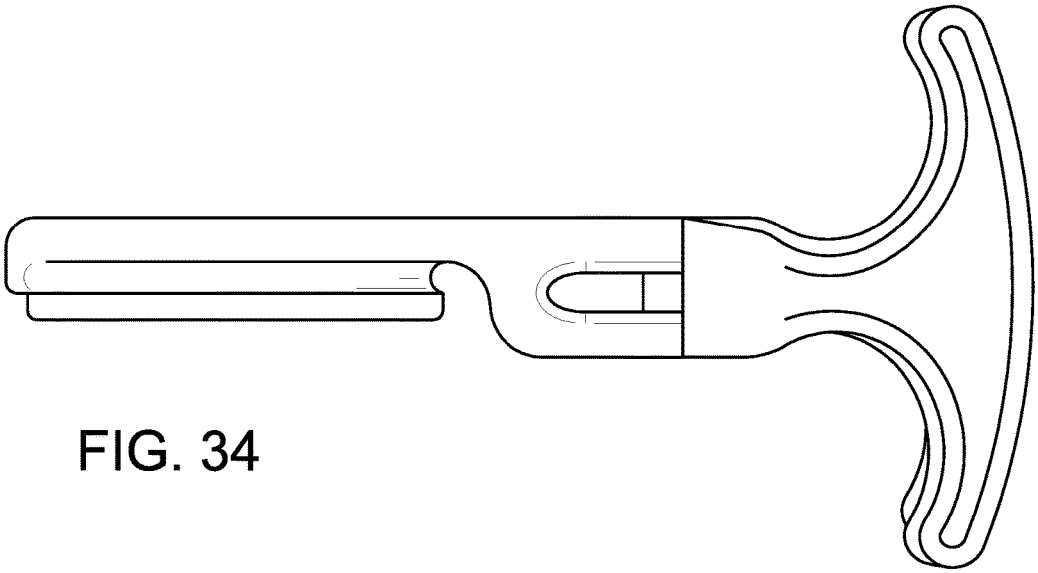
FIG. 34 is a perspective view of one embodiment of a crossbow cocking system.
Figure 35:
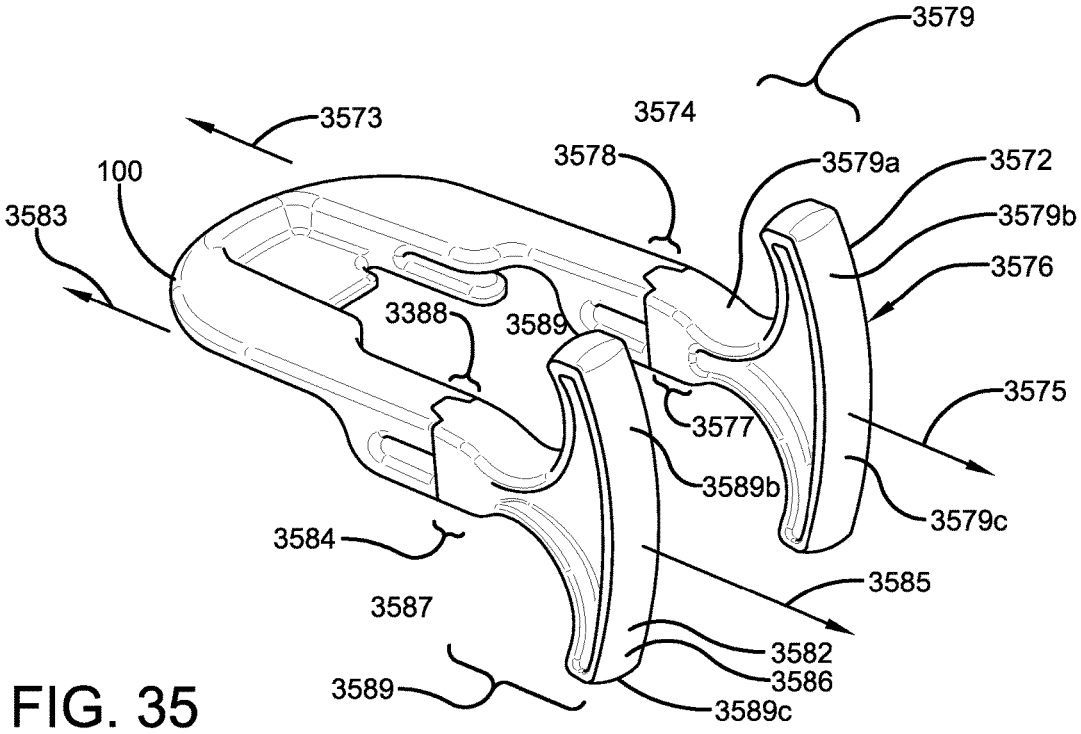
FIG. 35 is a perspective view of one embodiment of a crossbow cocking system.
Figure 36:
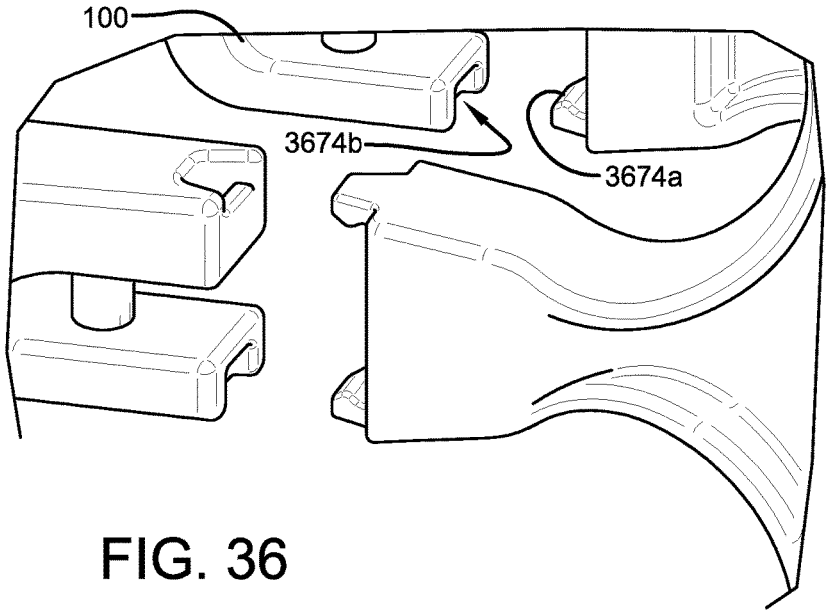
FIG. 36 is a close up perspective view of one embodiment of a crossbow cocking system.
Figure 37:
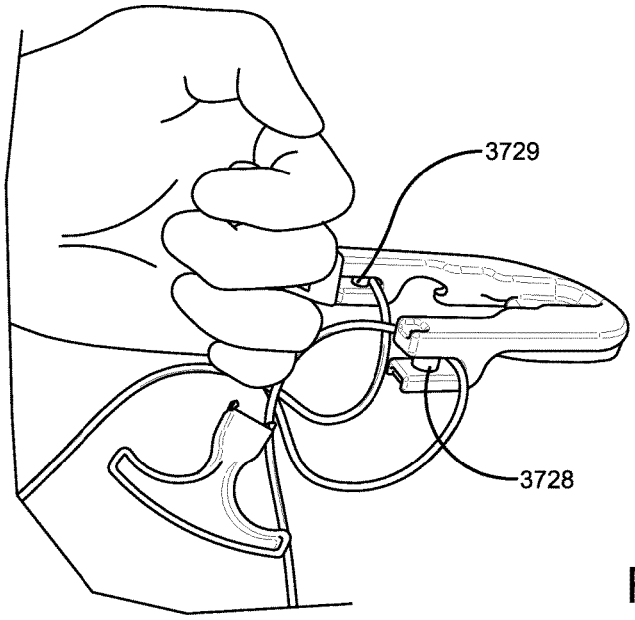
FIG. 37 is a picture of a user grasping by hand one handle of one embodiment of a crossbow cocking system.
Figure 38:
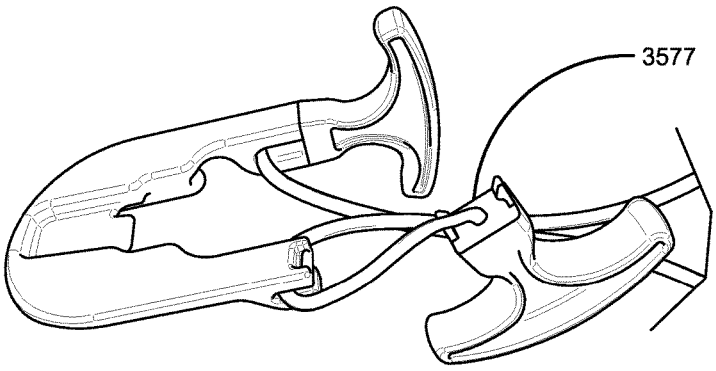
FIG. 38 is a picture of one embodiment of a crossbow cocking system with a first handle in snap fit engagement with the sled and a second handle disengaged from the sled.
Figure 39:
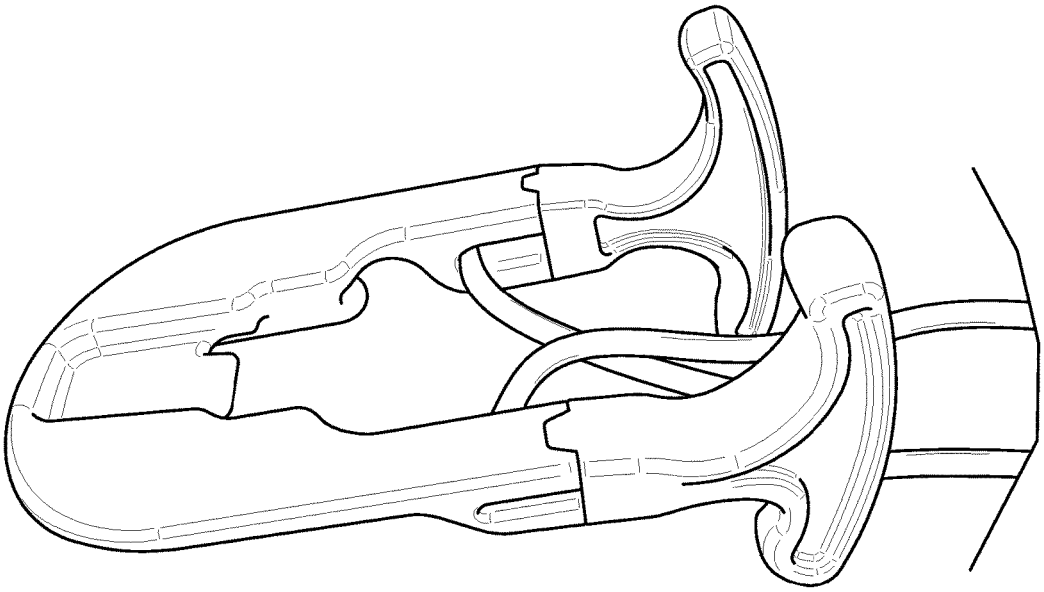
FIG. 39 is a perspective view of one embodiment of a crossbow cocking system.
Figure 40:
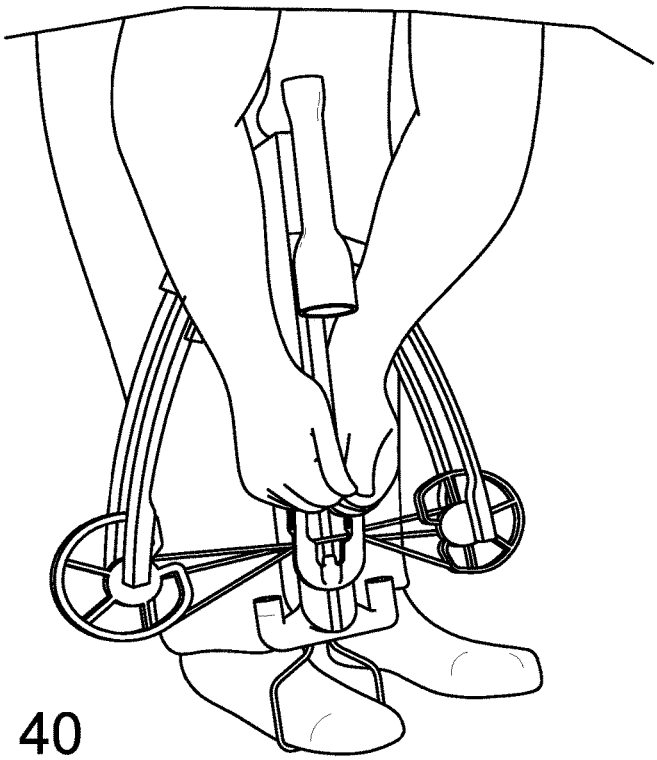
FIG. 40 is a picture of a crossbow being cocked by a user.
Figure 41:
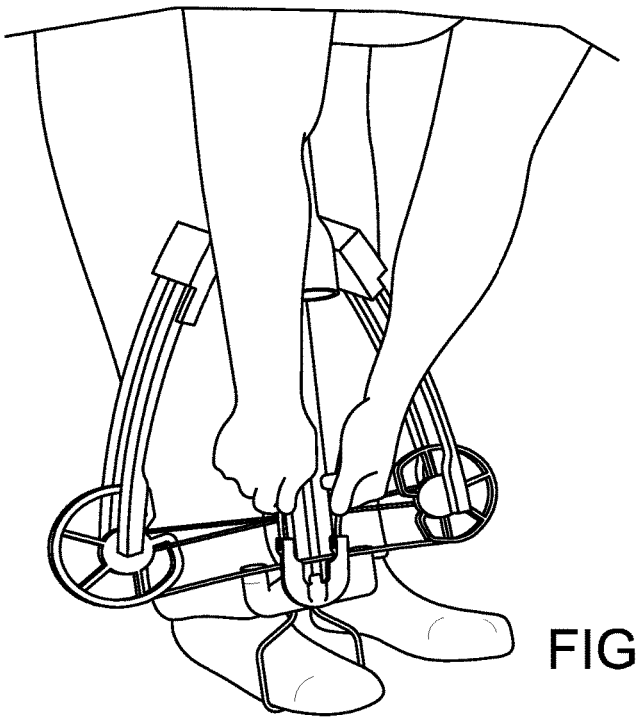
FIG. 41 is a picture of a crossbow being cocked by a user.
Figure 42:
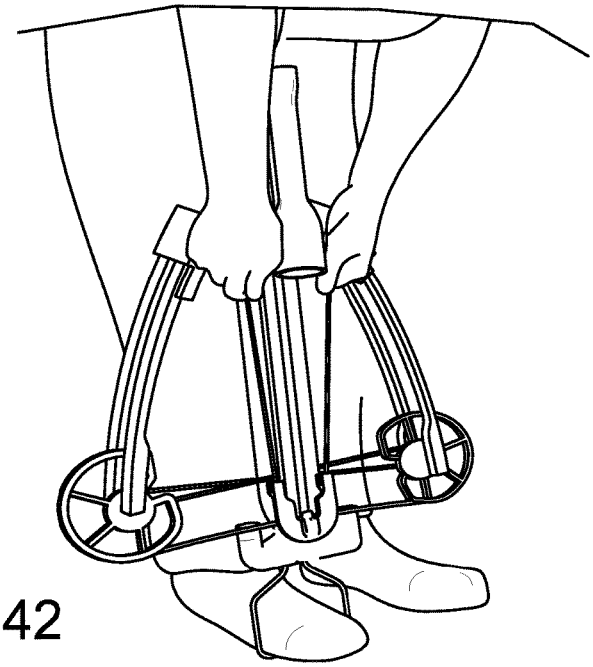
FIG. 42 is a picture of a crossbow being cocked by a user.
Figure 43:
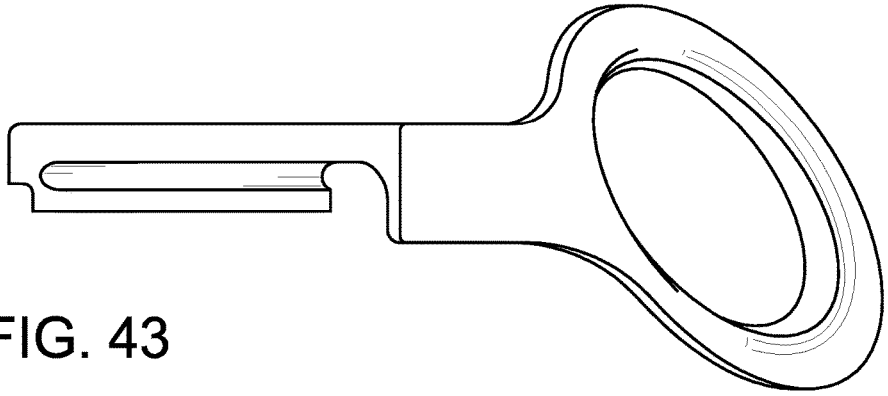
FIG. 43 is a perspective view of one embodiment of a crossbow cocking system.
Figure 44:
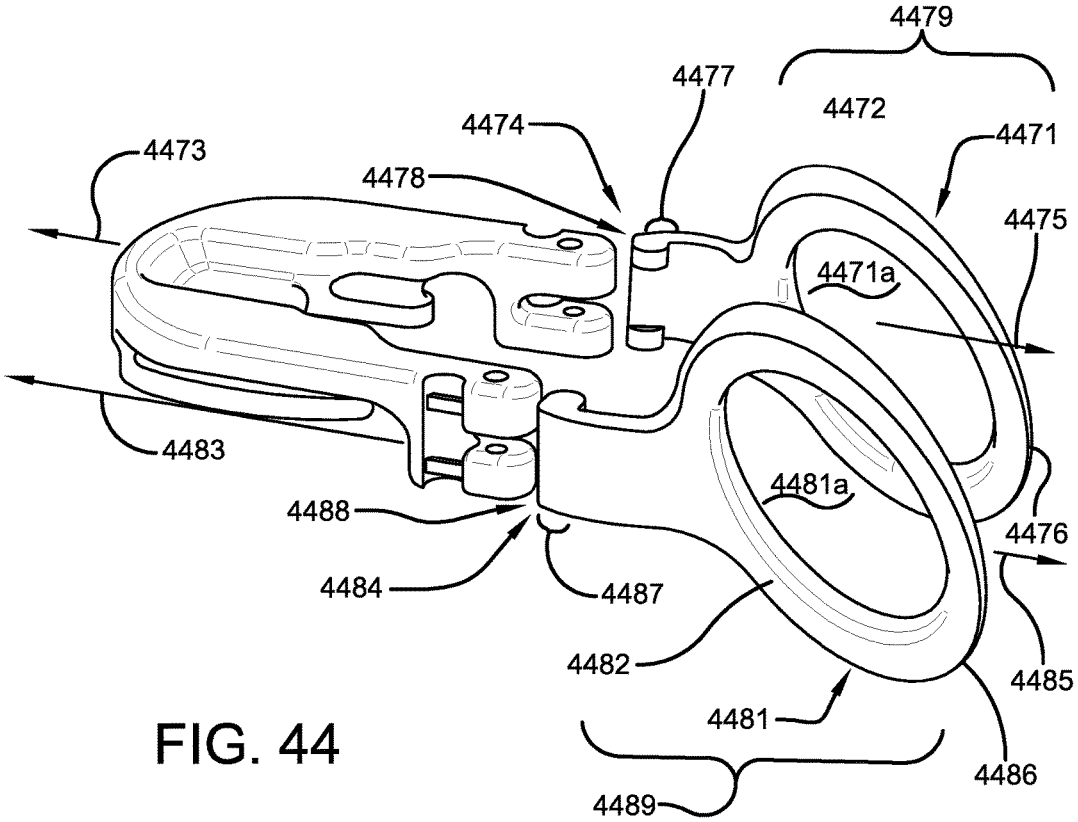
FIG. 44 is a perspective exploded view of one embodiment of a crossbow cocking system.
Figure 45:
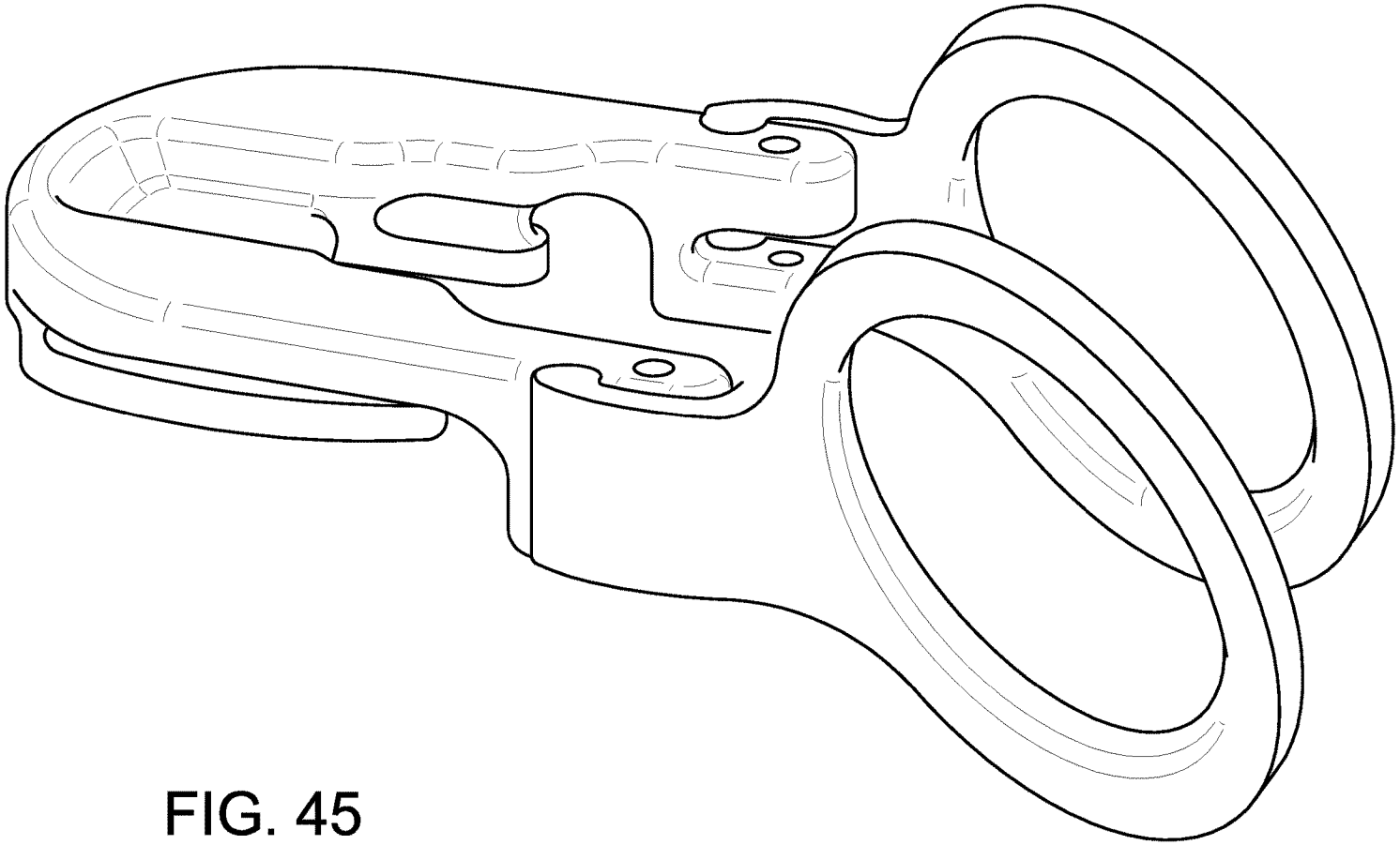
FIG. 45 is a perspective view of one embodiment of a crossbow cocking system.
Figure 46:
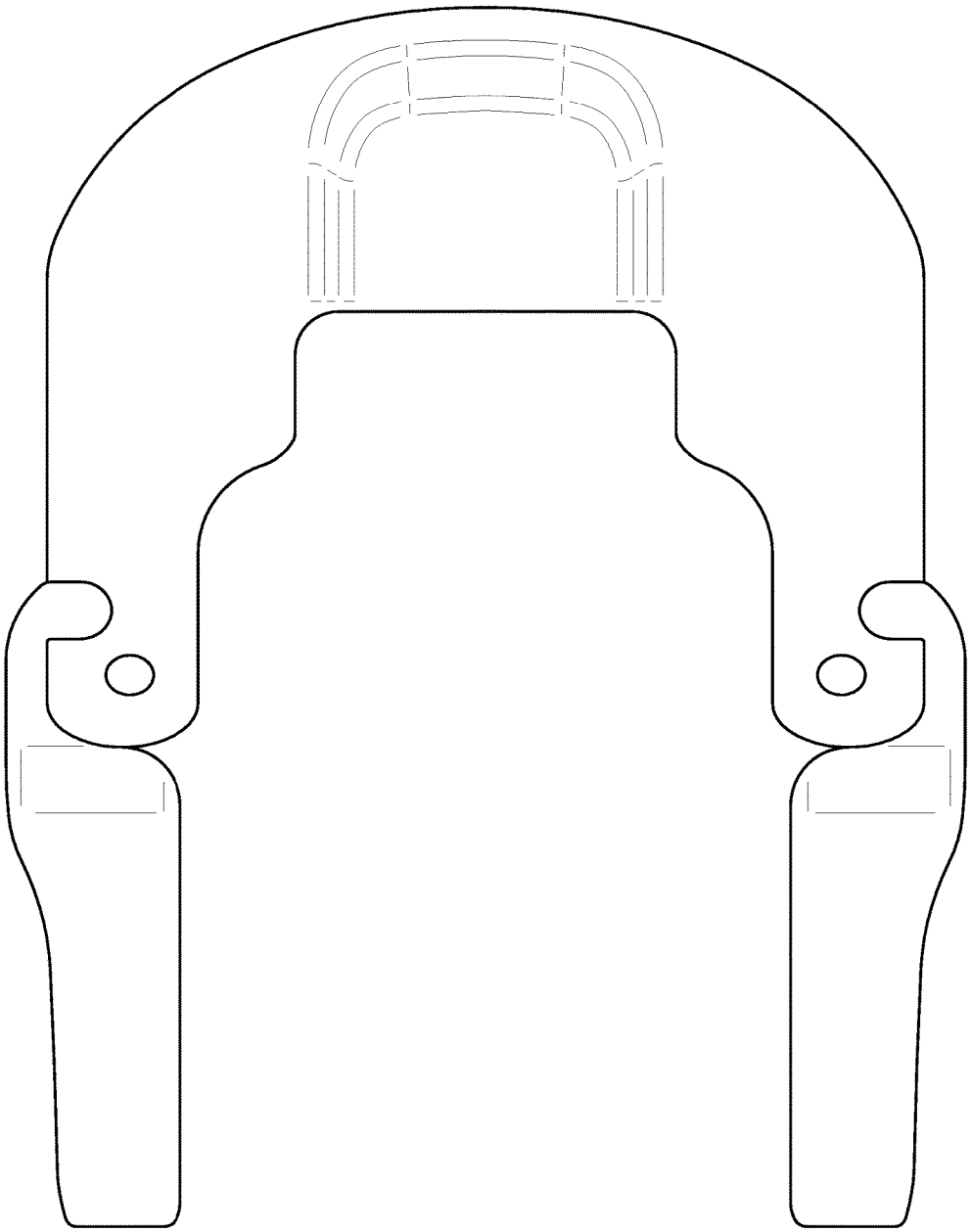
FIG. 46 is a perspective view of one embodiment of a crossbow cocking system.
Figure 47:
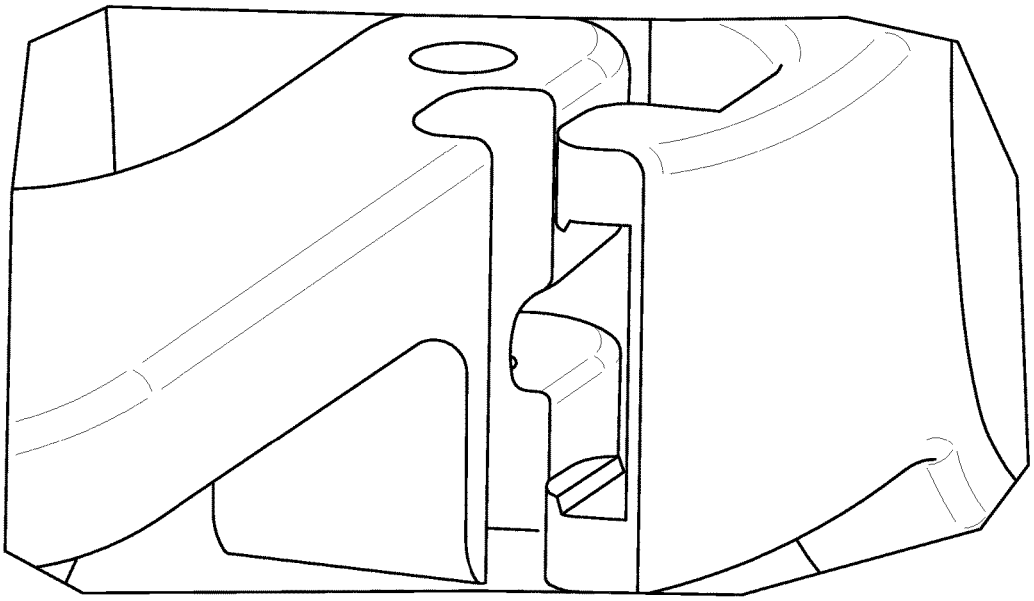
FIG. 47 is a close up perspective view of one embodiment of a crossbow cocking system.
Figure 48:
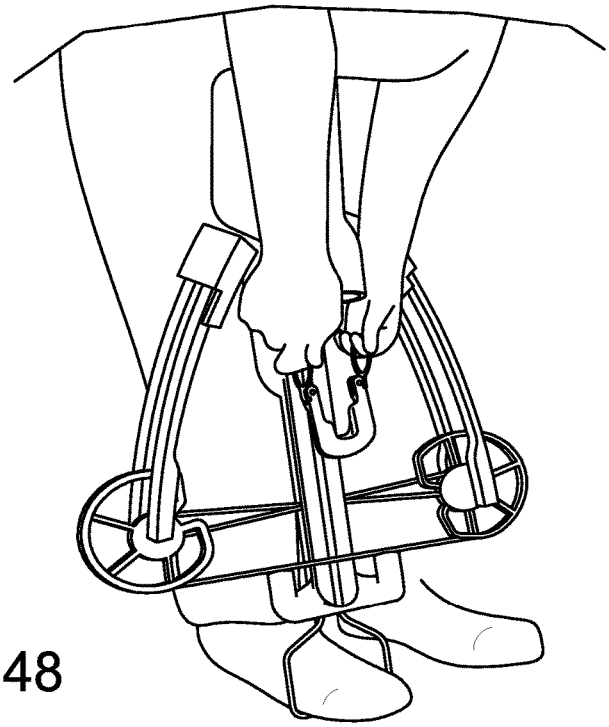
FIG. 48 is a picture of a crossbow being cocked by a user.
Figure 49:
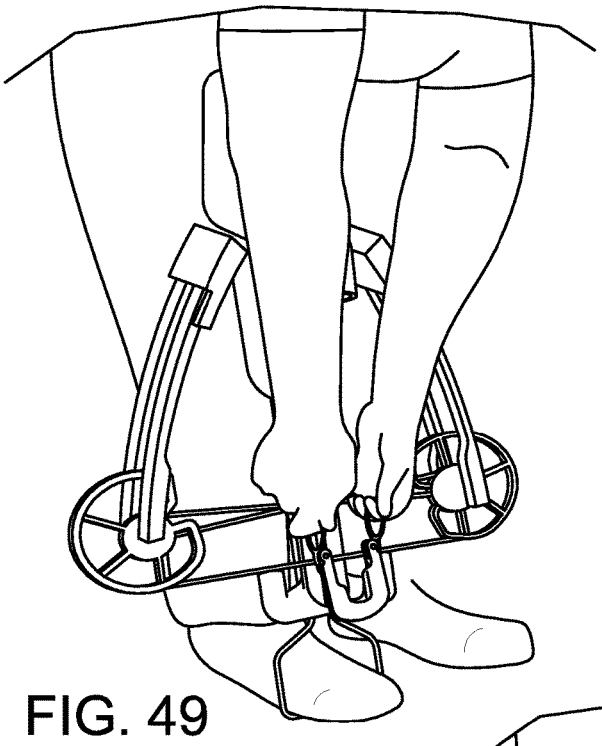
FIG. 49 is a picture of a crossbow being cocked by a user.
Figure 50:
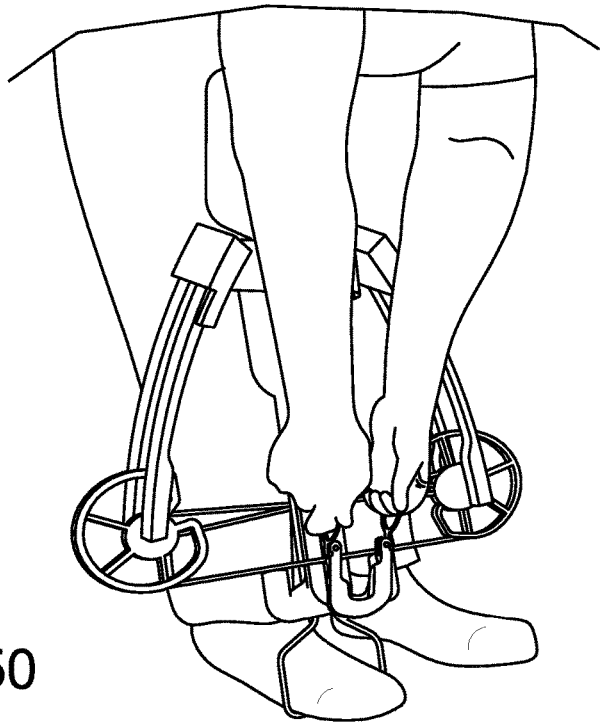
FIG. 50 is a picture of a crossbow being cocked by a user.
Figure 51:
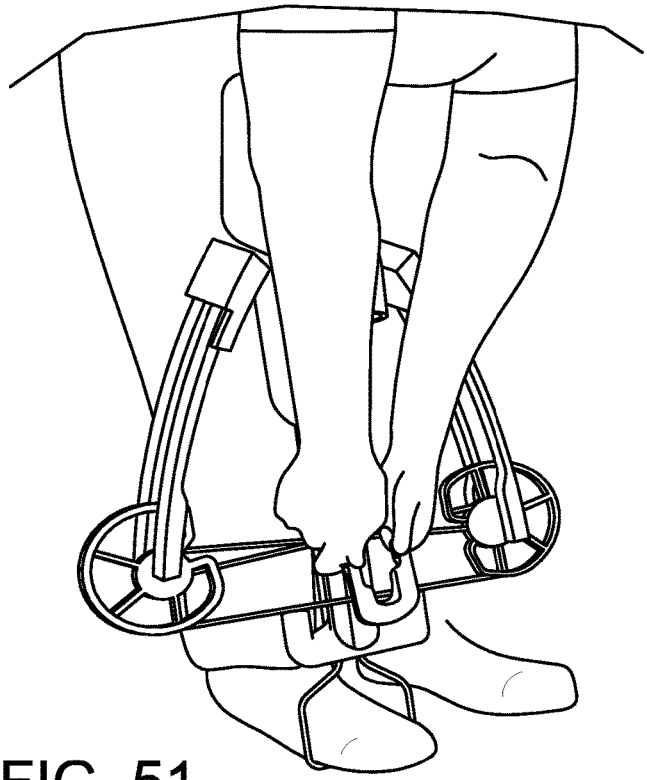
FIG. 51 is a picture of a crossbow being cocked by a user.
Figure 52:
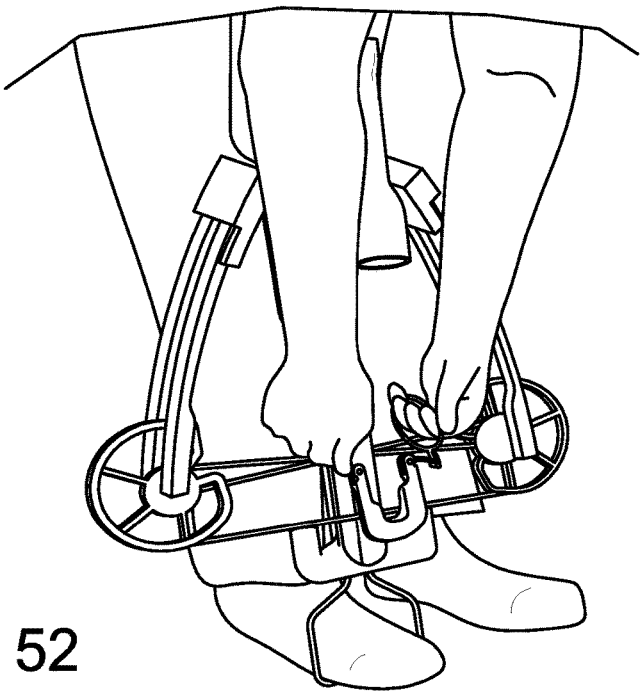
FIG. 52 is a picture of a crossbow being cocked by a user.
Figure 53:
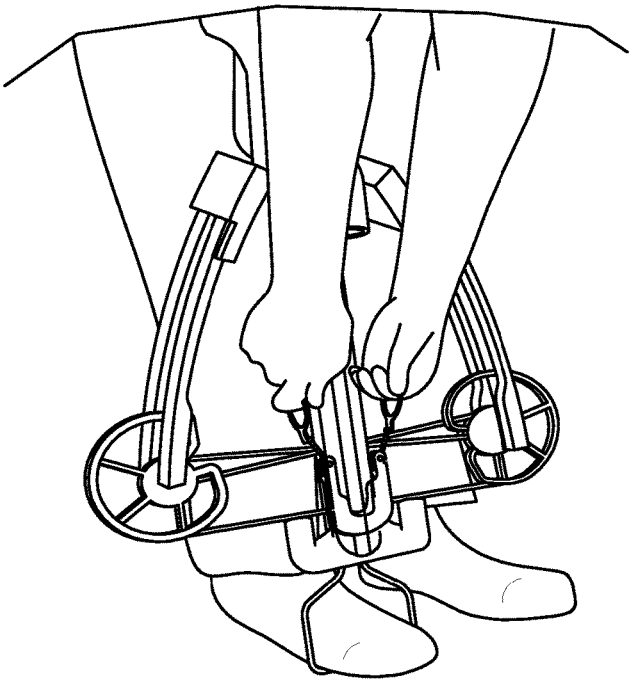
FIG. 53 is a picture of a crossbow being cocked by a user.
Figure 54:
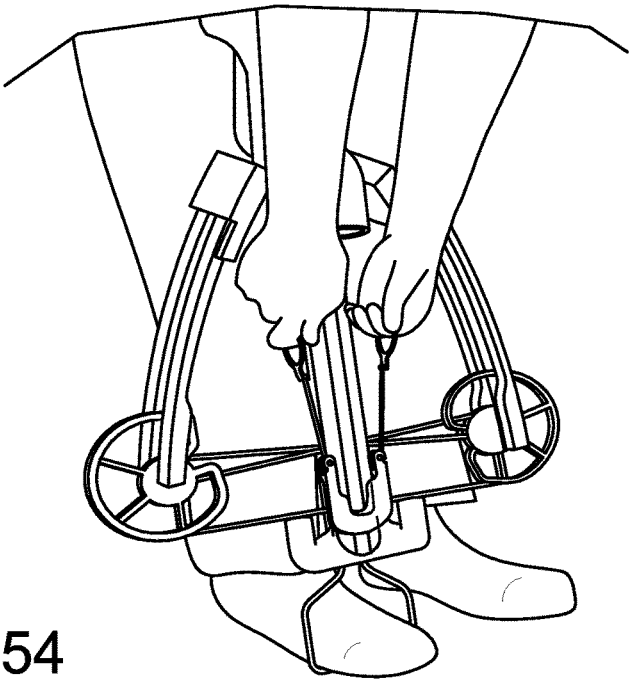
FIG. 54 is a picture of a crossbow being cocked by a user.
Figure 55:
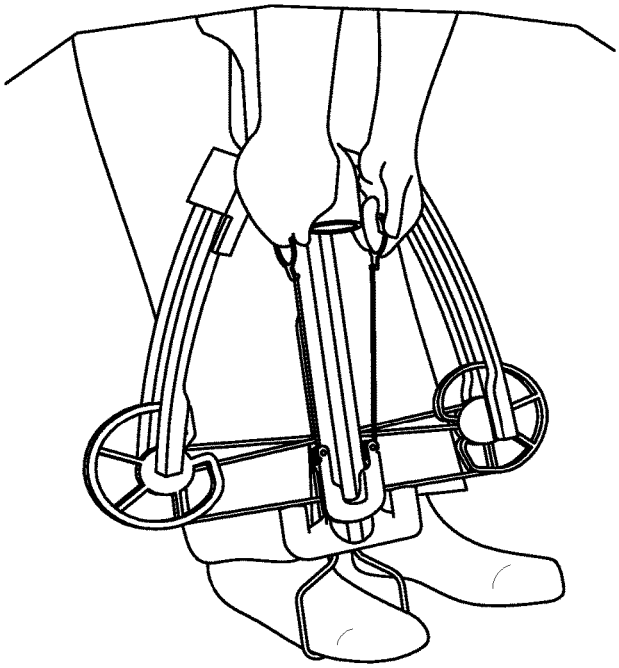
FIG. 55 is a picture of a crossbow being cocked by a user.
Figure 56:
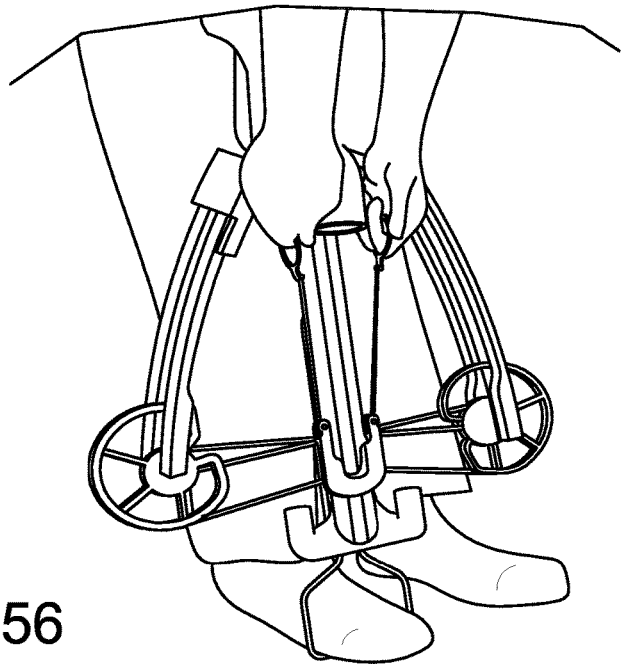
FIG. 56 is a picture of a crossbow being cocked by a user.
Figure 57:
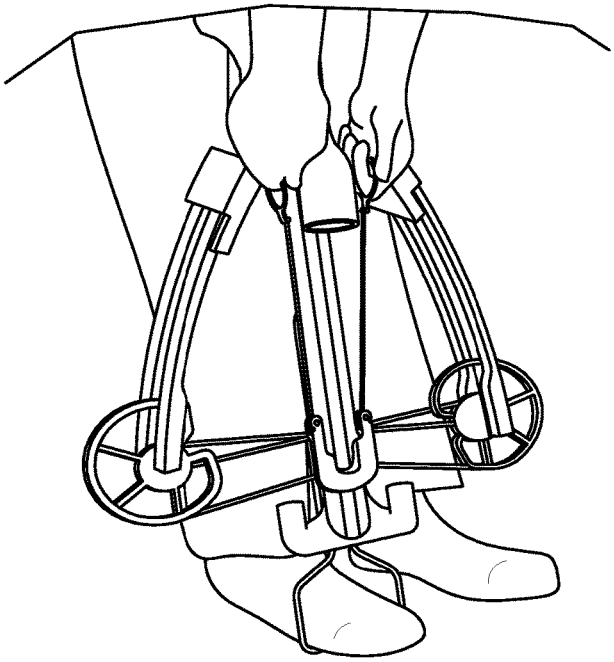
FIG. 57 is a picture of a crossbow being cocked by a user.
Figure 58:
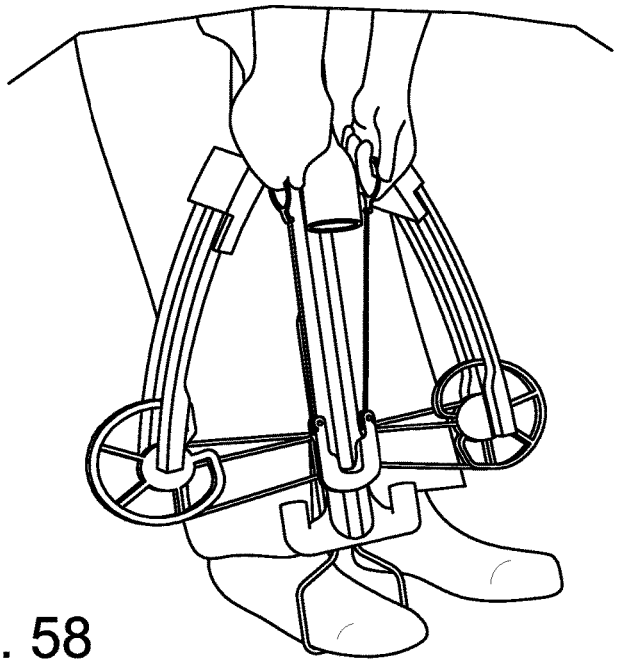
FIG. 58 is a picture of a crossbow being cocked by a user.
Figure 59:
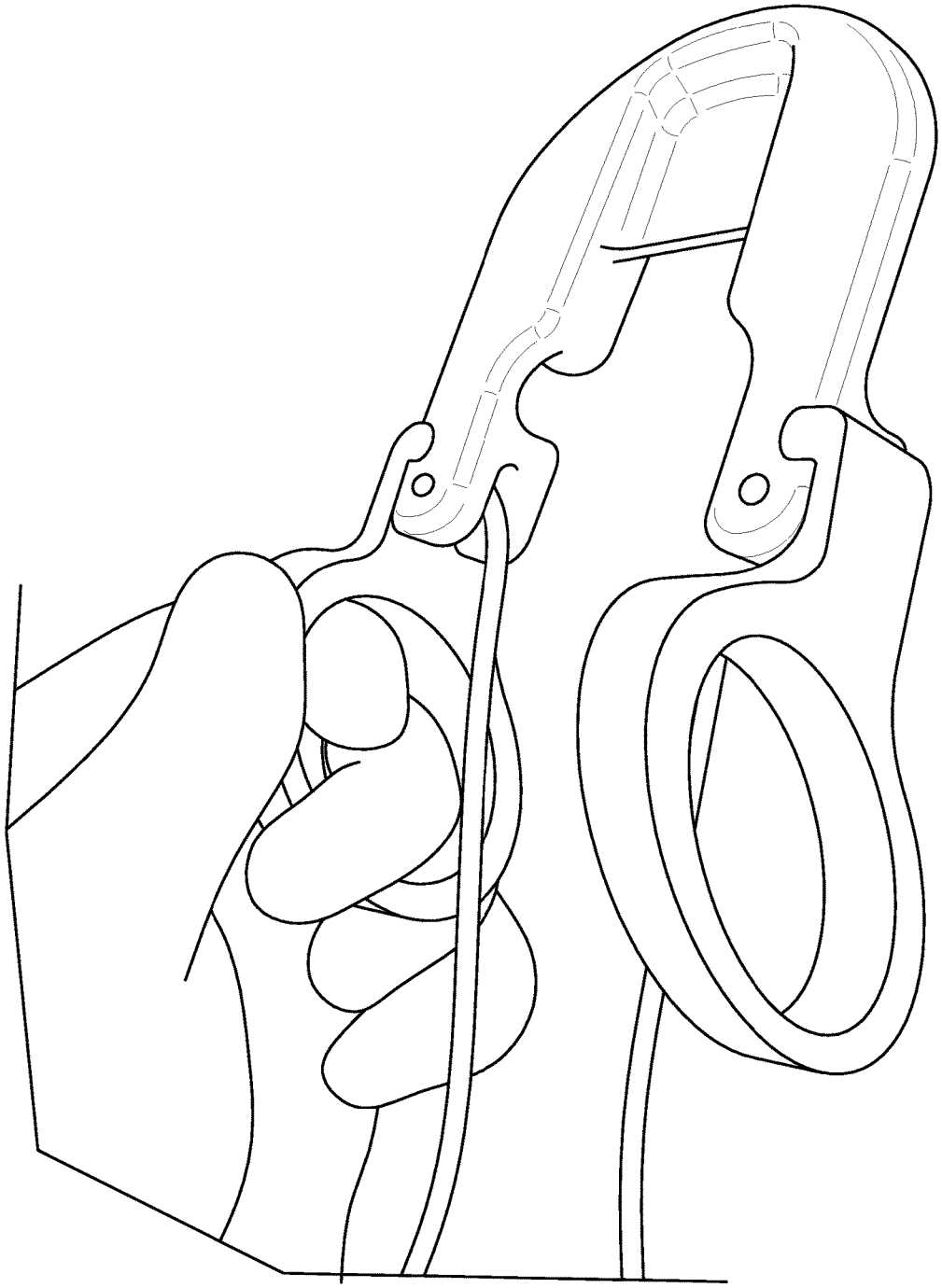
FIG. 59 is a picture of a user grasping by hand one handle of one embodiment of a crossbow cocking system.
Figure 60:
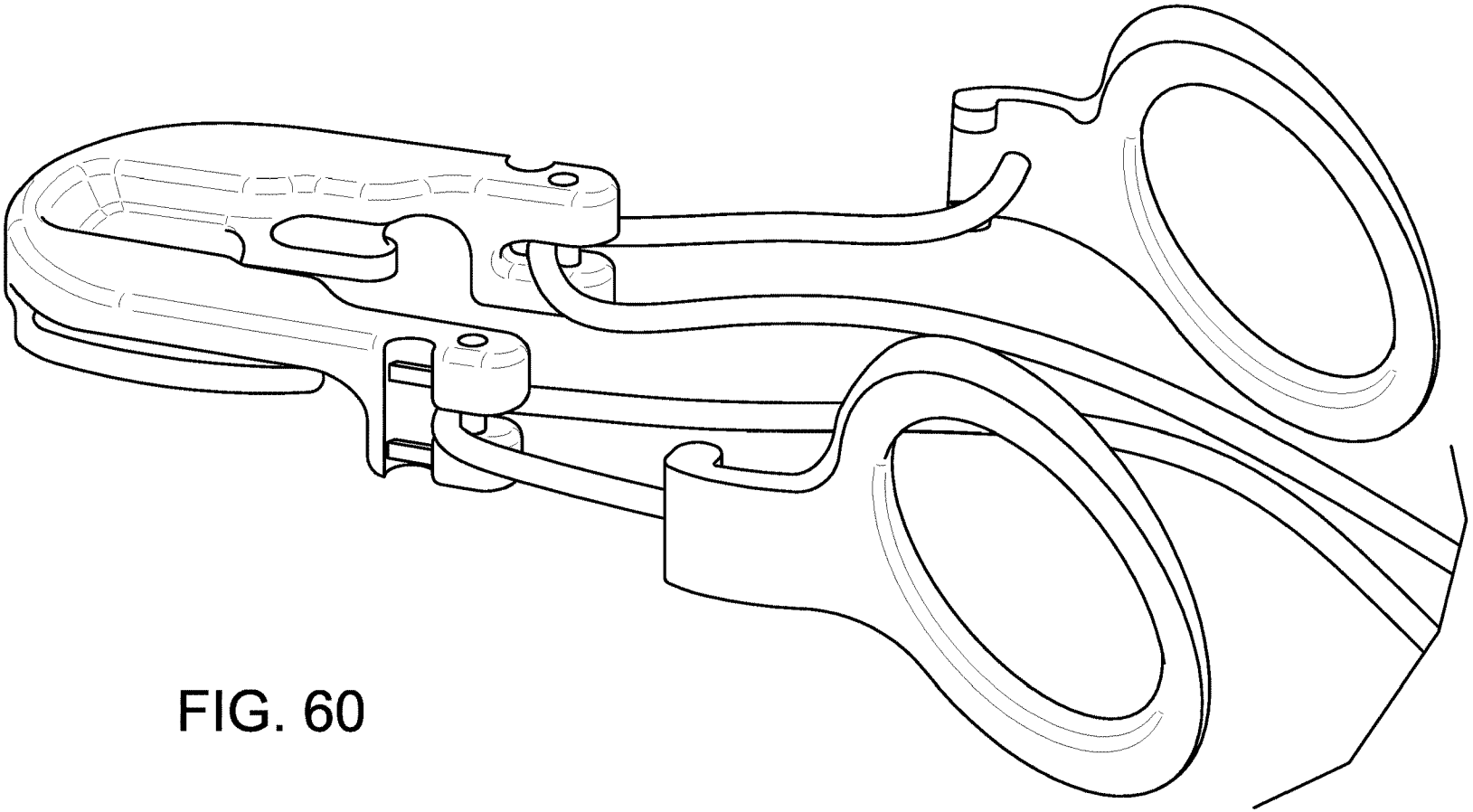
FIG. 60 is a perspective view of one embodiment of a crossbow cocking system.

A first T-handle 3572 may be elongated to define a first forward direction 3573 toward a first handle front 3574 and a first rearward direction 3575 toward a first handle back 3576 opposite the first handle front 3574. A first T-handle 3572 may have a cable engagement region 3577 biased toward the first handle front 3574 to define a first forward handle region 3578 between the first handle front 3574 and the cable engagement region 3577. The first handle front 3574 may have one or more snap components 3674*a* adapted for snap fit engagement with one or more counterpart snap components 3674*b* on the sled 100. A first T-handle 3572 may have a first rearward handle region 3579 between the first handle back 3576 and the cable engagement region 3577. A first rearward handle region 3579 may be T-shaped having a stem 3579*a*, a first cross piece 3579*b* perpendicular to stem 3579*a*, and a second cross piece 3579*c* perpendicular to stem 3579*a*. A T-shaped handle may have the conventional meaning of being shaped like the letter "T". It is contemplated that in some non-limiting embodiments, a T-shaped handle may deviate in some ways from the conventional meaning of being shaped like the letter "T", the cross pieces may be not quite perpendicular to the stem or the cross pieces may be not quite parallel to one another. As shown in FIGS. 34-35, there may some curvature to the cross pieces 3579*b* and 3579*c* in some non-limiting embodiments.

A first loop handle 4472 may be elongated to define a first forward direction 4473 toward a first handle front 4474, and may be elongated to define a first rearward direction 4475 toward a first handle back 4476 opposite the first handle front 4474. A first loop handle 4472 may have a first cable engagement region 4477 biased toward the first handle front 4474 to define a first forward handle region 4478 between the first handle front 4474 and the first cable engagement region 4477 and a first rearward handle region 4479 between the first handle back 4476 and the first cable engagement region 4477. In a first loop handle 4472 the first rearward handle region may have a closed loop 4471 defining a through hole 4471*a*.

The second handle 880 may be operationally engaged to the elongated cocking cable 1260 at the second end 1264. The second handle is ergonomically adapted to permit an associated user to operate the second handle during a cocking operation with a second hand in a vertical hand position. Acceptable non-limiting forms for the second handle 880 include second compact handle 882, second transition handle 1882 a second T-handle 3582, and a second loop handle 4482.

A second compact handle 882 may be elongated to define a first forward direction 883 toward a first handle front 884, and may be elongated to define a first rearward direction 885 toward a first handle back 886 opposite the first handle front 884. A second compact handle 882 may have a first cable engagement region 887 biased toward the first handle front 884 to define a first forward handle region 888 between the first handle front 884 and the first cable engagement region 887 and a first rearward handle region 889 between the first handle back 886 and the first cable engagement region 887. The first forward handle region 888 may increase in cross-sectional area in the first forward direction 883 over at least a portion thereof. The first rearward handle region 889 may increase in cross-sectional area in the first rearward direction 885 over at least a portion thereof.

A second transition handle 1882 may be elongated to define a first forward direction 1883 toward a first handle front 1884 and a first rearward direction 1885 toward a first handle back 1886 opposite the first handle front 1884. A second transition handle 1882 may have a cable engagement region 1887 biased toward the first handle front 1884 to define a first forward handle region 1888 between the first handle front 1884 and the cable engagement region 1887, a first rearward handle region 1889 between the first handle back 1886 and the cable engagement region 1887, and a spur 1881 or projection extending from the handle 1882 between the first forward handle region 1888 and the first rearward handle region 1889. In some non-limiting embodiments, the first forward handle region 1888 may have a convex finger receptacle 1881*a* adjacent to and partially defined by the spur 1881.

A first T-handle 3582 may be elongated to define a first forward direction 3583 toward a first handle front 3584 and a first rearward direction 3585 toward a first handle back 3586 opposite the first handle front 3584. A first T-handle 3582 may have a cable engagement region 3587 biased toward the first handle front 3584 to define a first forward handle region 3588 between the first handle front 3584 and the cable engagement region 3587. The first handle front 3584 may have one or more snap components 3684*a* adapted for snap fit engagement with one or more counterpart snap components 3684*b* on the sled 100. A first T-handle 3582 may have a first rearward handle region 3589 between the first handle back 3586 and the cable engagement region 3587. A first rearward handle region 3589 may be T-shaped having a stem 3589*a*, a first cross piece 3589*b* perpendicular to stem 3589*a*, and a second cross piece 3589*c* perpendicular to stem 3589*a*. A T-shaped handle may have the conventional meaning of being shaped like the letter "T". It is contemplated that in some non-limiting embodiments, a T-shaped handle may deviate in some ways from the conventional meaning of being shaped like the letter "T", the cross pieces may be not quite perpendicular to the stem or the cross pieces may be not quite parallel to one another. As shown in FIGS. 34-35, there may some curvature to the cross pieces 3589*b* and 3589*c* in some non-limiting embodiments.

A first loop handle 4482 may be elongated to define a first forward direction 4483 toward a first handle front 4484, and may be elongated to define a first rearward direction 4485 toward a first handle back 4486 opposite the first handle front 4484. A first loop handle 4482 may have a first cable engagement region 4487 biased toward the first handle front 4484 to define a first forward handle region 4488 between the first handle front 4484 and the first cable engagement region 4487 and a first rearward handle region 4489 between the first handle back 4486 and the first cable engagement region 4487. In a first loop handle 4482 the first rearward handle region may have a closed loop 4481 defining a through hole 4481*a*.

Components that are adapted for snap fit engagement with one or more counterpart snap components are components that are selectably engageable by an interference fit. The interference fit is characterized by having some snap force required to join or separate the components from one another. As used in some embodiments of the crossbow cocking devices disclosed herein, components may be adapted for snap fit engagement wherein the snap force is sufficiently high to permit the joined components to be carried about as an assembly by holding only one component and to be engaged with an associated crossbow without the assembly falling apart, but wherein the cocking force input during a cocking operation is greater than the snap force and sufficient to separate the snap fit components.

Numerous embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

Having thus described the invention, it is now claimed.

We claim:

1. A crossbow cocking system comprising a sled having a first side having
a first bowstring retainer, and
a first arm having a first set of handle engagement features adapted for engagement with a first handle,
a first pulley rotatably engaged with the first arm,
a second side having
a second bowstring retainer, and
a second arm having a second set of handle engagement features adapted for engagement with a second handle,
a second pulley rotatably engaged with the second arm, and
wherein the second side is offset from the first side by a gap;
an elongated cocking cable having
a first end, and
a second end offset from the first end;
a first handle being
engaged to the elongated cocking cable at the first end,
wherein said first handle is ergonomically adapted to permit an associated user to operate the first handle during a cocking operation with a first hand in a vertical hand position; and
a second handle
engaged to the elongated cocking cable at the second end,
wherein said second handle is ergonomically adapted to permit an associated user to operate the second handle during a cocking operation with a second hand in a vertical hand position;
wherein the first bowstring retainer defines a first bowstring groove;
wherein the second bowstring retainer defines a second bowstring groove;
wherein the gap is of sufficient width to accommodate fitting around the trigger assembly of an associated crossbow;
wherein at least one handle is a loop handle
elongated to define
a forward direction toward a handle front and
a rearward direction toward a handle back opposite the handle front,
having a cable engagement region biased toward the handle front to define
a forward handle region between the handle front and the cable engagement region,
a rearward handle region between the handle back and the cable engagement region, and
the rearward handle region having a closed loop defining a through hole; and
wherein the first set of handle engagement features includes magnets adapted to engage ferrous or magnetic counterpart components.

2. A method of cocking a crossbow comprising
providing a crossbow having a bowstring;
providing a crossbow cocking system having
a sled having
a first side having
a first bowstring retainer, and
a first arm having a first set of handle engagement features adapted for engagement with a first handle,
a first pulley rotatably engaged with the first arm,
a second side having
a second bowstring retainer, and
a second arm having a second set of handle engagement features adapted for engagement with a second handle,
a second pulley rotatably engaged with the second arm, and
wherein the second side is offset from the first side by a gap, and
an elongated cocking cable having
a first end, and
a second end offset from the first end, and
a first handle being
engaged to the elongated cocking cable at the first end,
wherein said first handle is ergonomically adapted to permit an associated user to operate the first handle during a cocking operation with a first hand in a vertical hand position, and
a second handle
engaged to the elongated cocking cable at the second end,
wherein said second handle is ergonomically adapted to permit an associated user to operate the second handle during a cocking operation with a second hand in a vertical hand position;
operatively engaging the crossbow cocking system with the crossbow;
cocking the crossbow by operating
the first handle, and
the second handle;
wherein operatively engaging the crossbow cocking system with the crossbow includes retaining the bowstring using the first bowstring retainer;
wherein the first bowstring retainer defines a first bowstring groove;
wherein the second bowstring retainer defines a second bowstring groove;
wherein the gap is of sufficient width to accommodate fitting around the trigger assembly of an associated crossbow;
wherein at least one handle is a loop handle
elongated to define
a forward direction toward a handle front and
a rearward direction toward a handle back opposite the handle front,
having a cable engagement region biased toward the handle front to define
a forward handle region between the handle front and the cable engagement region,
a rearward handle region between the handle back and the cable engagement region, and
the rearward handle region having a closed loop defining a through hole; and
wherein the first set of handle engagement features includes magnets adapted to engage ferrous or magnetic counterpart components.

3. A crossbow cocking system comprising
a sled having
a first side having
a first bowstring retainer, the first bowstring retainer defining a first bowstring groove,
a first arm having a first set of handle engagement features adapted for engagement with a first handle, and
a first pulley rotatably engaged with the first arm,
a second side having
a second bowstring retainer, the second bowstring retainer defining a second bowstring groove and a second arm having a second set of handle engagement features adapted for engagement with a second handle, a second pulley rotatably engaged with the second arm, and wherein the second side is offset from the first side by a gap, the gap being of sufficient width to accommodate fitting around the trigger assembly of an associated crossbow;

an elongated cocking cable having a first end, and a second end offset from the first end;

a first handle being engaged to the elongated cocking cable at the first end, wherein said first handle is ergonomically adapted to permit an associated user to operate the first handle during a cocking operation with a first hand in a vertical hand position;

a second handle engaged to the elongated cocking cable at the second end, wherein said second handle is ergonomically adapted to permit an associated user to operate the second handle during a cocking operation with a second hand in a vertical hand position;

wherein at least one handle is a) a compact handle being elongated to define a forward direction toward a handle front, and a rearward direction toward a handle back opposite the handle front, and having a cable engagement region biased toward the handle front to define a forward handle region between the handle front and the cable engagement region, the forward handle region increasing in cross-sectional area in the forward direction over at least a portion thereof, and a rearward handle region between the handle back and the cable engagement region, the rearward handle region increasing in cross-sectional area in the rearward direction over at least a portion thereof; or b) a transition handle being elongated to define a forward direction toward a handle front and a rearward direction toward a handle back opposite the handle front, having a cable engagement region biased toward the handle front to define a forward handle region between the handle front and the cable engagement region, a rearward handle region between the handle back and the cable engagement region, and a spur or projection extending from the handle between the forward handle region and the rearward handle region, and wherein the forward handle region has a convex finger receptacle adjacent to and partially defined by the spur; or c) a T-handle being elongated to define a forward direction toward a handle front and a rearward direction toward a handle back opposite the handle front, having a cable engagement region biased toward the handle front defining a forward handle region between the handle front and the cable engagement region, the forward handle region having one or more snap components adapted for snap fit engagement with a counterpart snap components on the sled, a rearward handle region between the handle back and the cable engagement region, and wherein the rearward handle region has a T-shaped handle;

or d) a loop handle being elongated to define a forward direction toward a handle front and a rearward direction toward a handle back opposite the handle front, having a cable engagement region biased toward the handle front to define a forward handle region between the handle front and the cable engagement region, a rearward handle region between the handle back and the cable engagement region, and the rearward handle region having a closed loop defining a through hole;

wherein the first set of handle engagement features includes magnets adapted to engage ferrous or magnetic counterpart components; and wherein the second set of handle engagement features includes magnets adapted to engage ferrous or magnetic counterpart components.

* * * * *